US011709515B1

(12) United States Patent
Asano et al.

(10) Patent No.: US 11,709,515 B1
(45) Date of Patent: Jul. 25, 2023

(54) VOLTAGE REGULATOR WITH N-TYPE POWER SWITCH

(71) Applicant: Dialog Semiconductor (UK) Limited, London (GB)

(72) Inventors: Hiroki Asano, Kanagawa (JP); Katsuhiko Ariyoshi, Kanagawa (JP); Susumu Tanimoto, Tokyo (JP)

(73) Assignee: Dialog Semiconductor (UK) Limited, London (GB)

( * ) Notice: Subject to any disclaimer, the term of this patent is extended or adjusted under 35 U.S.C. 154(b) by 53 days.

(21) Appl. No.: 17/388,291

(22) Filed: Jul. 29, 2021

(51) Int. Cl.
*G05F 1/59* (2006.01)
*G05F 1/575* (2006.01)
*G05F 1/563* (2006.01)

(52) U.S. Cl.
CPC ..... *G05F 1/575* (2013.01); *G05F 1/563* (2013.01); *G05F 1/59* (2013.01)

(58) Field of Classification Search
CPC ..... G05F 1/563; G05F 1/575; G05F 1/59
See application file for complete search history.

(56) References Cited

U.S. PATENT DOCUMENTS 6,617,832 B1 * 9/2003 Kobayashi ..... H02M 3/07 323/280
8,248,150 B2 8/2012 Tadeparthy et al.
8,598,854 B2 12/2013 Soenen et al.
9,778,672 B1 * 10/2017 Gao ..... G05F 1/575
10,423,178 B1 9/2019 Chen
2006/0273771 A1 12/2006 van Ettinger et al.
2008/0224680 A1 9/2008 Suzuki
2014/0070782 A1 3/2014 Pons et al.
2014/0340058 A1 11/2014 Wang
(Continued)

FOREIGN PATENT DOCUMENTS

CN 104079300 A 10/2014
CN 203982121 U 12/2014
(Continued)

OTHER PUBLICATIONS

"Ultralow-quiescent-current and wide-load-range low-dropout linear regulator with self-biasing technique for micropower battery management," by Toshihiro Ozaki et al., Japanese Journal of Applied Physics, vol. 56, No. 4S, 04CF11, Mar. 17, 2017, 7 pages.

*Primary Examiner* — Sisay G Tiku
(74) *Attorney, Agent, or Firm* — Saile Ackerman LLC; Stephen B. Ackerman

(57) ABSTRACT

A voltage regulator and a corresponding method of regulating a voltage are presented. The voltage regulator includes an N-type power switch, an error amplifier, and a switch capacitor circuit. The switch capacitor circuit includes a first capacitor coupled to a network of switches, the switch capacitor circuit has a first port coupled to an output the error amplifier, a second port coupled to an output terminal of the power switch, and a third port coupled to a control terminal of the power switch. The switch capacitor circuit is iteratively operable between a first phase and a second phase. In the first phase the first port is coupled to ground via a path comprising the first capacitor, and in the second phase the second port is coupled to the third port via a path comprising the first capacitor. The voltage regulator may be implemented as a low dropout regulator.

16 Claims, 25 Drawing Sheets

(56) References Cited

U.S. PATENT DOCUMENTS

| | | | | |
|---|---|---|---|---|
| 2015/0311783 | A1* | 10/2015 | Saadat | G05F 1/575<br>323/267 |
| 2017/0060155 | A1* | 3/2017 | Peluso | G05F 1/575 |
| 2020/0144913 | A1* | 5/2020 | Harjani | G05F 1/565 |
| 2021/0405674 | A1* | 12/2021 | Xue | G05F 1/575 |

FOREIGN PATENT DOCUMENTS

| | | | |
|---|---|---|---|
| CN | 105183067 | A | 12/2015 |
| CN | 106685193 | A | 5/2017 |
| CN | 107688366 | A | 2/2018 |
| CN | 108508951 | A | 9/2018 |
| CN | 110649902 | A | 1/2020 |
| CN | 112068630 | A | 12/2020 |
| CN | 112256081 | A | 1/2021 |
| EP | 2895931 | A1 | 7/2015 |
| KR | 20120098025 | A | 9/2012 |

* cited by examiner $V_{ngate,n}=(1/3)V_{AMP}$ (Sampling phase)

$V_{ngate,n+1}=(1/3)V_{AMP}$ (Holding phase)

$V_{ngate,n+2}=((5/3)V_{AMP}+2V_{OUT,n+2}-V_{OUT,1})/3$ (Sampling phase)

$V_{ngate,n+3}=((5/3)V_{AMP}+2V_{OUT,n+2}-V_{OUT,1})/3$ (Holding phase)

$C_L = 1.0\ \mu F$ $C_L$=0.1 μF

| $C_L$(μF) | Conv. (mV) | Prop. (mV) | Reduction rate*(%) |
|---|---|---|---|
| 0.1 | 23.66 | 5.06 | 78.6 |
| 0.5 | 8.18 | 1.86 | 77.3 |
| 1 | 3.96 | 1.01 | 74.5 |
| 2.2 | 1.44 | 0.61 | 57.6 |
| 4.7 | 0.62 | 0.26 | 58.1 |

Reduction rate*=1-Prop/Conv

Input Range: 2.8–11V

Accuracy: Less than 1%

$$\text{Current Efficiency} = \frac{I_L}{I_{IN}} = \frac{I_L}{I_L + I_q}$$

VOLTAGE REGULATOR WITH N-TYPE POWER SWITCH

TECHNICAL FIELD

The present disclosure relates to a voltage regulator, in particular the present disclosure relates to a linear voltage regulator such as a low-dropout regulator comprising a N-type power switch.

BACKGROUND

Linear voltage regulators such low-dropout regulators (LDOs) can be used in many applications to provide a constant or near constant output voltage. In essence an LDO acts as a variable resistance between an input voltage and a load to control the output voltage applied to the load.

Among the many applications, LDOs can be used for charging a battery of a user device. Battery charging techniques for portable devices include USB power deliver (USB-PD) and wireless power transfer (WPT). Both USB-PD and WPT can handle both high voltage and high current. An LDO used for charging a battery also requires both capabilities to reduce charging time. However, conventional LDO circuits compatible with high voltage and high current require a relatively large implementation area and can be limited by significant output voltage ripples. It is an object of the disclosure to address one or more of the above-mentioned limitations.

SUMMARY

According to a first aspect of the disclosure, there is provided a voltage regulator comprising a power switch having a control terminal, an input terminal for receiving an input voltage, and an output terminal for providing an output voltage, wherein the power switch is a N-type power switch; an error amplifier; and a switch capacitor circuit comprising a first capacitor coupled to a network of switches, the switch capacitor circuit having a first port coupled to an output the error amplifier, a second port coupled to the output terminal of the power switch, and a third port coupled to the control terminal of the power switch, the switch capacitor circuit being iteratively operable between a first phase and a second phase, wherein in the first phase the first port is coupled to ground via a path comprising the first capacitor, and in the second phase the second port is coupled to the third port via a path comprising the first capacitor.

Optionally, the error amplifier is adapted to provide an error voltage, and the switch capacitor circuit is adapted to generate a control voltage for controlling the power switch.

Optionally, during the first phase the first capacitor charges.

Optionally, during the first phase the first capacitor charges to a voltage substantially equal to the error voltage.

Optionally, during the second phase the control voltage is maintained at a given value.

Optionally, the first phase and the second phase form a switching cycle.

For instance, the given value given may be determined by an iteration of the switching cycle.

Optionally, the control voltage reaches a value substantially equal to the sum of the error voltage and the output voltage after a plurality of iterations of the switching cycle.

Optionally, the control voltage increases during a transient period between the first phase and the second phase.

Optionally, the control voltage increases above a rail voltage provided to the error amplifier.

Optionally, the network of switches comprises a first switch to couple a first terminal of the first capacitor to the first port; a second switch to couple the first terminal of the first capacitor to the third port; a third switch to couple a second terminal of the first capacitor to the second port; a fourth switch to couple the second terminal of the first capacitor to ground.

Optionally, the switch capacitor circuit comprises a second capacitor, wherein in the first phase the second port is couple to the third port via a path comprising the second capacitor, and wherein in the second phase the first port is coupled to ground via a path comprising the second capacitor.

Optionally, the network of switches comprises a fifth switch to couple a first terminal of the second capacitor to the first port; a sixth switch to couple the first terminal of the second capacitor to the third port; a seventh switch to couple a second terminal of the second capacitor to the second port; an eighth switch to couple the second terminal of the second capacitor to ground.

Optionally, the switch capacitor circuit comprises another capacitor provided between the first port and the third port.

Optionally, the voltage regulator is a linear voltage regulator. For example, the linear voltage regulator may be a low dropout regulator (LDO).

According to a second aspect of the disclosure, there is provided a charging device comprising a voltage regulator according to the first aspect of the disclosure.

The charging device according to the second aspect of the disclosure may comprise any of the features described above in relation to the voltage regulator according to the first aspect of the disclosure.

According to a third aspect of the disclosure, there is provided a method of regulating a voltage, the method comprising providing a N-type power switch having a control terminal, an input terminal for receiving an input voltage, and an output terminal for providing an output voltage;

providing an error amplifier;

providing a switch capacitor circuit comprising a first capacitor coupled to a network of switches, the switch capacitor circuit having a first port coupled to an output the error amplifier, a second port coupled to the output terminal of the power switch, and a third port coupled to the control terminal of the power switch; and iteratively operating the switch capacitor circuit between a first phase and a second phase, wherein in the first phase the first port is coupled to ground via a path comprising the first capacitor, and in the second phase the second port is couple to the third port via a path comprising the first capacitor.

The options described with respect to the first aspect of the disclosure are also common to the third aspect of the disclosure.

BRIEF DESCRIPTION OF THE DRAWINGS

The disclosure is described in further detail below by way of example and with reference to the accompanying drawings, in which.

DESCRIPTION

Figure 1:
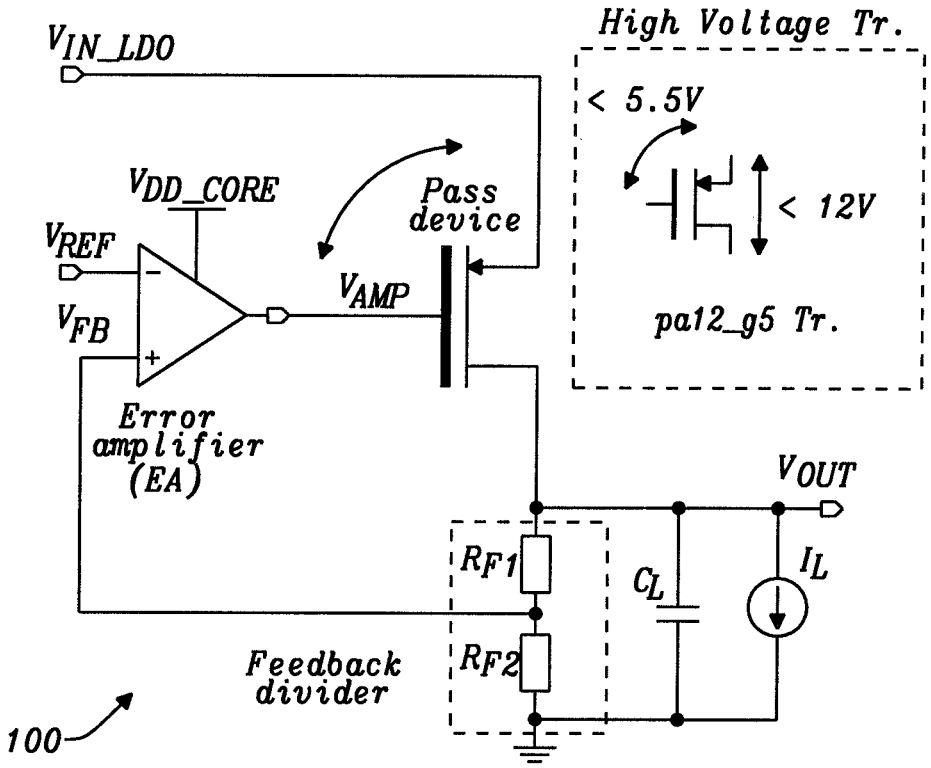
FIG. 1 Prior Art
FIG. 1 is a linear drop out (LDO) regulator with pMOS pass transistor according to the prior art.

FIG. 1 illustrates a conventional linear drop out (LDO) regulator provided with a high voltage p-type metal-oxide-silicon pMOS pass transistor. The LDO 100 includes a high-voltage pMOS transistor, an error amplifier, and a voltage divider. The high-voltage pMOS transistor has a gate terminal connected to the output of the error amplifier, a source terminal that receives an input voltage $V_{IN_LDO}$, and a drain terminal providing an output voltage $V_{OUT}$ that is connected to the voltage divider. The error amplifier has a non-inverting input receiving a feedback voltage $V_{FB}$ from the voltage divider and an inverting input receiving a reference voltage $V_{REF}$. In operation the error amplifier provides an amplifier error voltage $V_{AMP}$ to control the pMOS transistor. The output voltage $V_{OUT}$ is determined by $V_{REF}$ and the feedback ratio provided by the voltage divider. The circuit 100 provides a stable output voltage but requires a high-voltage pMOS transistor that is relatively large. Therefore, in order to achieve high current capability and small dropout voltage the circuit 100 requires a significant implementation area. For instance, considering the following numerical example if the on resistance of the pMOS power transistor is $R_{DS_ON}$=2 ohm and that a current capability $I_{OUT}$=is 200 mA is required, then the dropout voltage is $R_{DS_ON} \times I_{OUT}$=0.4V. If a smaller dropout voltage is required for example 0.2 V, then the LDO cannot satisfy this requirement due to the value of $R_{DS_ON}$.

Figure 2:
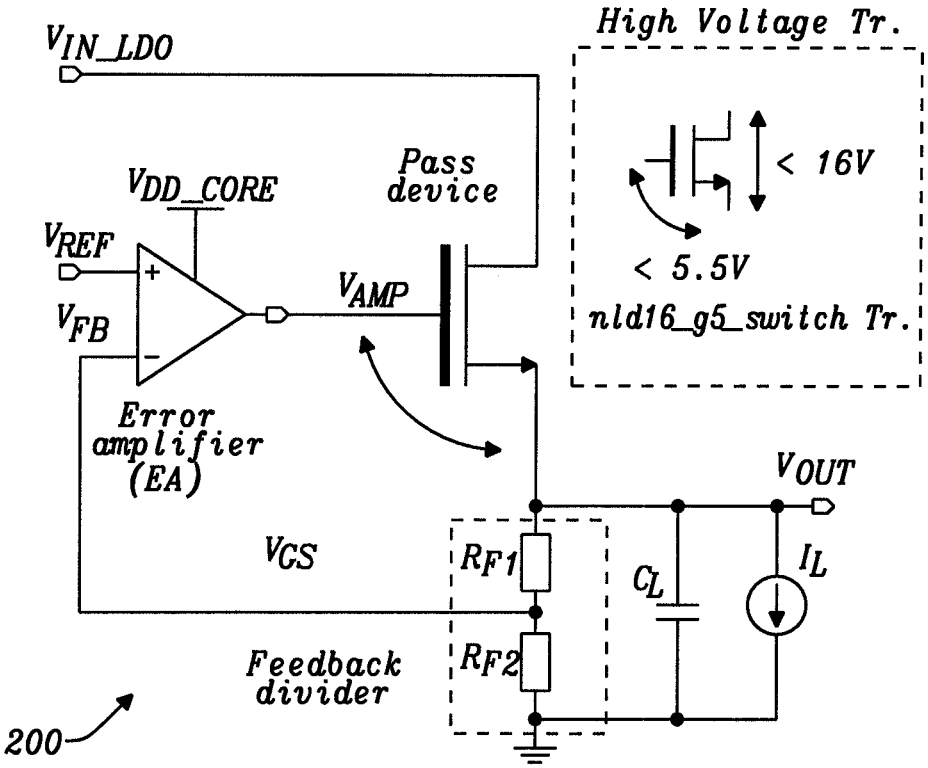
FIG. 2 Prior Art
FIG. 2 is a linear drop out (LDO) regulator with nMOS pass transistor according to the prior art.

FIG. 2 illustrates an LDO regulator provided with a n-type metal-oxide-silicon nMOS pass transistor according to the prior art. The LDO 200 includes a high-voltage nMOS transistor, an error amplifier, and a voltage divider. The high-voltage nMOS transistor has a gate terminal connected to the output of the error amplifier, a drain terminal that receives an input voltage $V_{IN_LDO}$, and a source terminal providing an output voltage $V_{OUT}$ that is connected to the voltage divider. The error amplifier has an inverting input receiving a feedback voltage $V_{FB}$ from the voltage divider and a non-inverting input receiving a reference voltage $V_{REF}$. In operation the error amplifier provides an amplifier error voltage $V_{AMP}$ to control the nMOS transistor. The LDO circuit 200 permits to handle high voltage and high current capability with a relatively small implementation area.

Figure 3A:
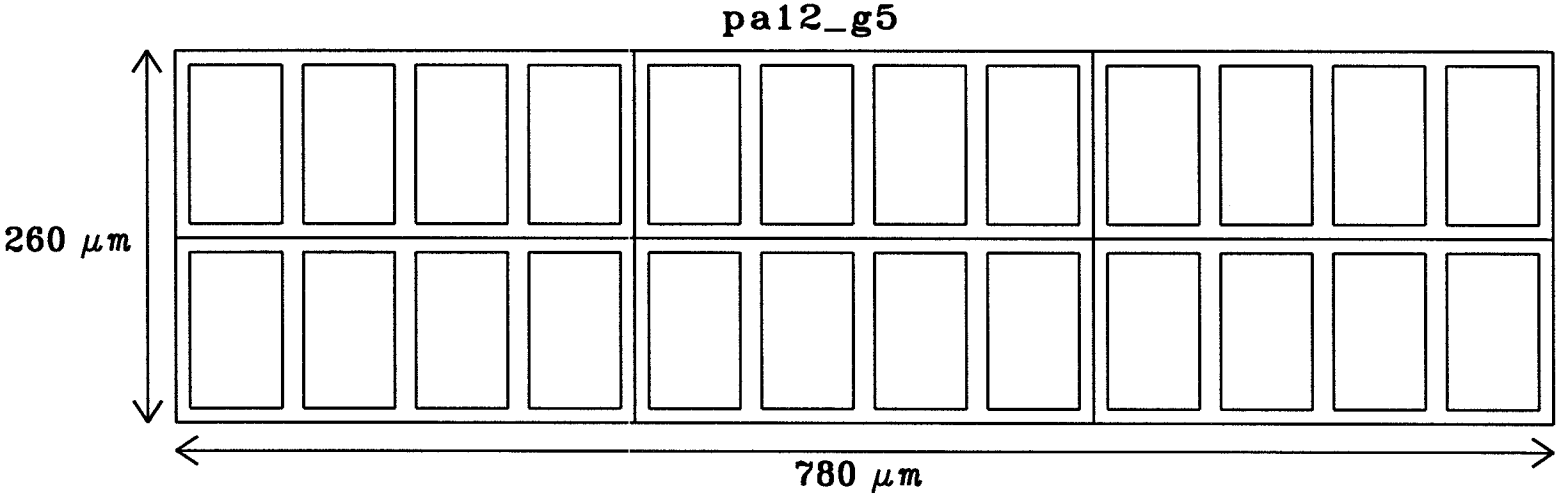
FIG. 3A is the circuit layout obtained for a pMOS LDO.
Figure 3B:
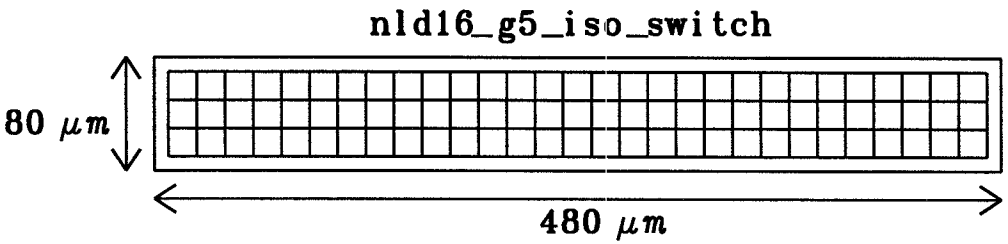
FIG. 3B is the circuit layout obtained for a nMOS LDO.

FIGS. 3A and 3B are schematic views of circuit layouts obtained for a pMOS LDO and an nMOS LDO, respectively. The layouts were obtained by setting a same $R_{DS_ON}$. A power transistor is formed a plurality of individual unit transistors. Since the pitch size of a nMOS unit transistor is smaller than the pitch size of a pMOS unit transistor, one can implement a nMOS power transistor with at higher density of individual unit transistors compared with a pMOS power transistors. The carrier mobility of nMOS transistors is also greater than the carrier mobility of pMOS transistors. Consequently, the number of individual unit transistors can be reduced for nMOS power transistors compared with pMOS power transistors. Therefore, using a nMOS power transistor as a pass device permits to reduce the LDO implementation area.

The gate to source voltage of the N-type power switch can be expressed as Vgs (NMOS)=Vg−Vs=$V_{AMP}-V_{OUT}$. To turn on the nMOS power transistor $V_{AMP}-V_{OUT}$ should be greater than the threshold voltage $V_{THN}$ of the NMOS power transistor ($V_{AMP}-(V_{OUT}+V_{THN})>0$). This requires the rail voltage $V_{DD_CORE}$ to be sufficiently high to generate the desired $V_{OUT}$. Otherwise, $V_{OUT}$ is limited by the threshold voltage $V_{THN}$ of the N-type power transistor.

Figure 4A:
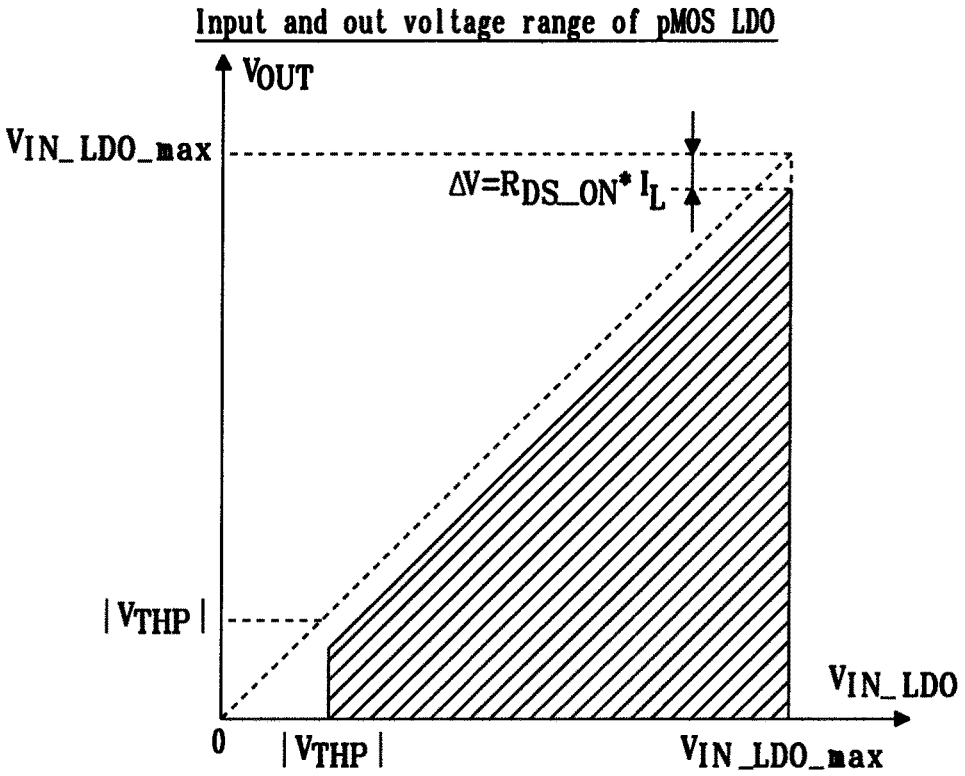
FIG. 4A is a plot of a pMOS LDO output voltage as a function of the LDO input voltage.
Figure 4B:
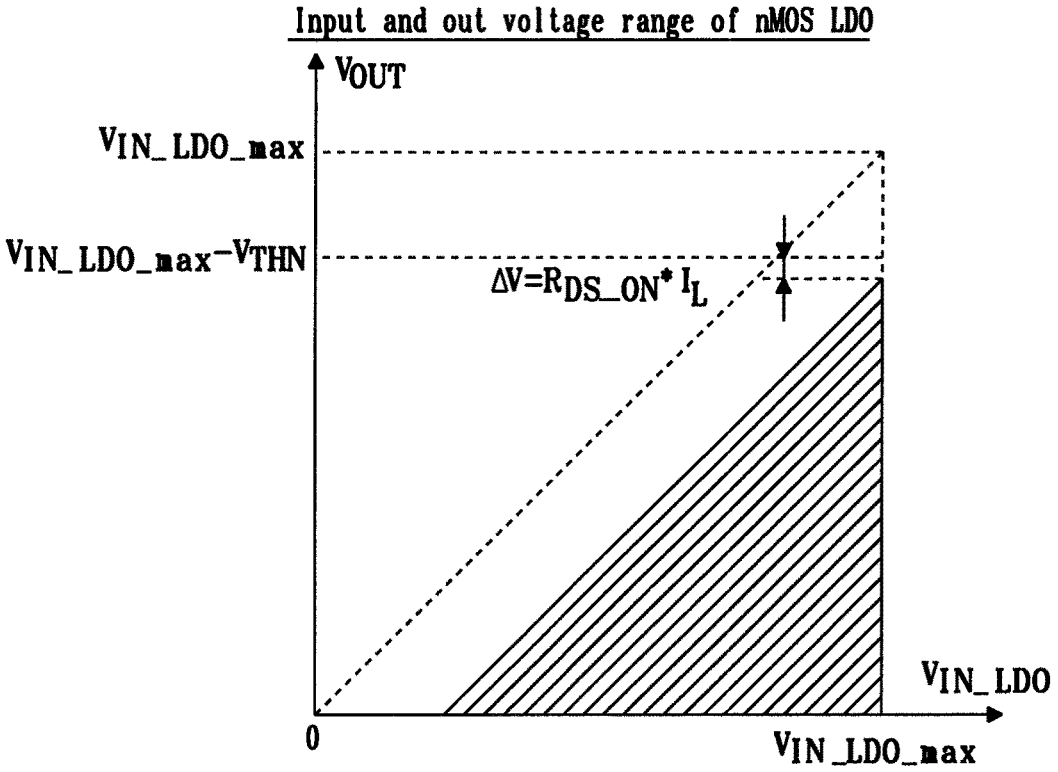
FIG. 4B is a plot of a nMOS LDO output voltage as a function of the LDO input voltage.

FIG. 4A is a plot of the output voltage Vout as a function of the input voltage $V_{IN_LDO}$ for a pMOS LDO. FIG. 4B is a plot of the output voltage Vout as a function of the input voltage $V_{IN_LDO}$ for a nMOS LDO. FIGS. 4A and 4B were obtained with $V_{IN_LDO}=V_{DD_CORE}$. The output voltage of the nMOS LDO is limited by the threshold voltage $V_{THN}$. The pMOS LDO cannot support lower range because it is also limited by $|V_{THP}|$.

Figure 5A:
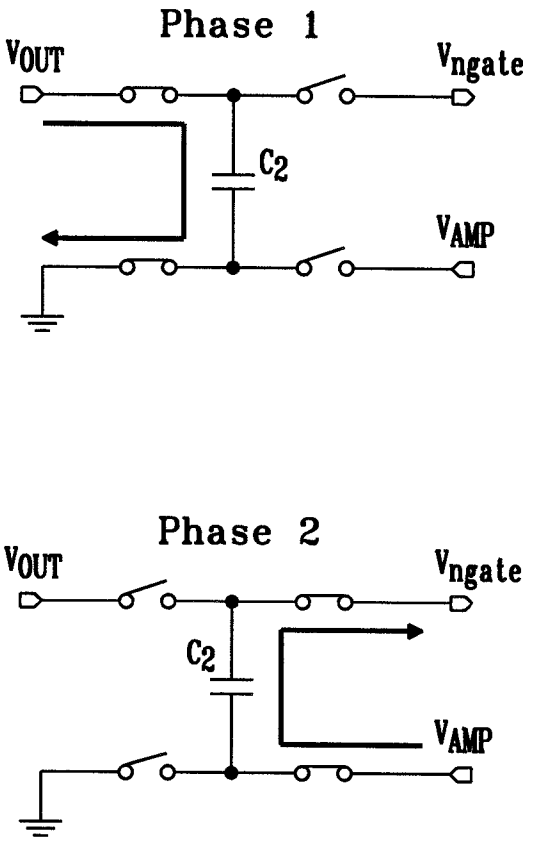
FIG. 5A Prior Art
FIG. 5A is a diagram of another nMOS LDO circuit according to the prior art.

FIG. 5A is a diagram of a nMOS LDO circuit 500 as described in US8248150B2. An error amplifier is connected to a nMOS pass transistor via a switch capacitor circuit formed by two capacitors C1 and C2 and four switches S1, S2, S3 and S4. The error amplifier provides an amplified error voltage $V_{AMP}$ and the capacitor circuit provides a voltage $V_{ngate}$ to control the nMOS transistor.

The circuit 500 operates in two phases, a first phase in which C2 is connected between the source terminal of the nMOS transistor and ground, and a second phase in which C2 is connected between the output of the error amplifier and the gate terminal of the nMOS pass transistor. During the first phase the capacitor C2 stores the output voltage $V_{OUT}$, and during the second phase $C_2$ is boosted by the amplified error voltage $V_{AMP}$.

The switch capacitor circuit is driven by non-overlapping clock signals to prevent short current at mode transition, that is between the first phase and the second phase. This causes ripple voltage at $V_{OUT}$. During the transition period between the first phase and the second phase both the output voltage $V_{OUT}$ and the gate voltage $V_{ngate}$ undershoot due to load current. The greater the load current the greater the undershoot. When a current load is applied to the LDO significant voltage ripples occur at the output. To reduce ripple voltage, a large output capacitor $C_L$ is required which increases the size of the circuit.

Figure 5A:
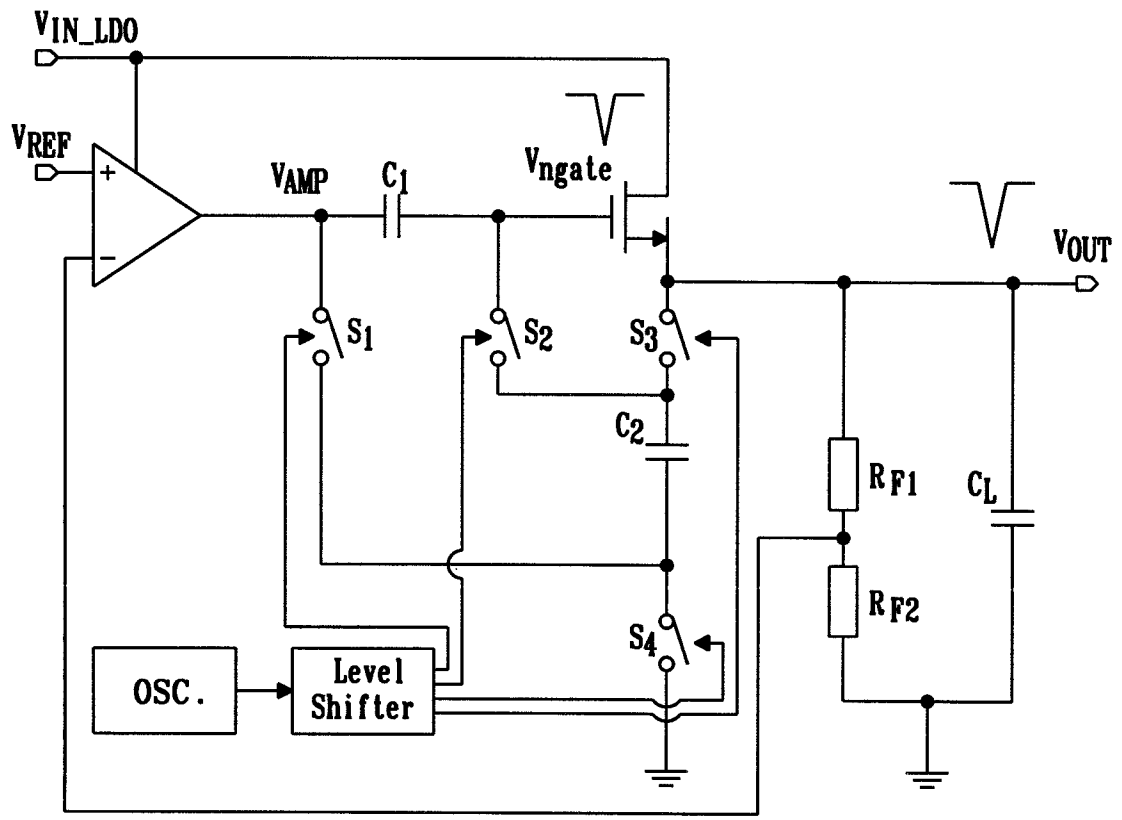
FIG. 5A Prior Art
Figure 5B:
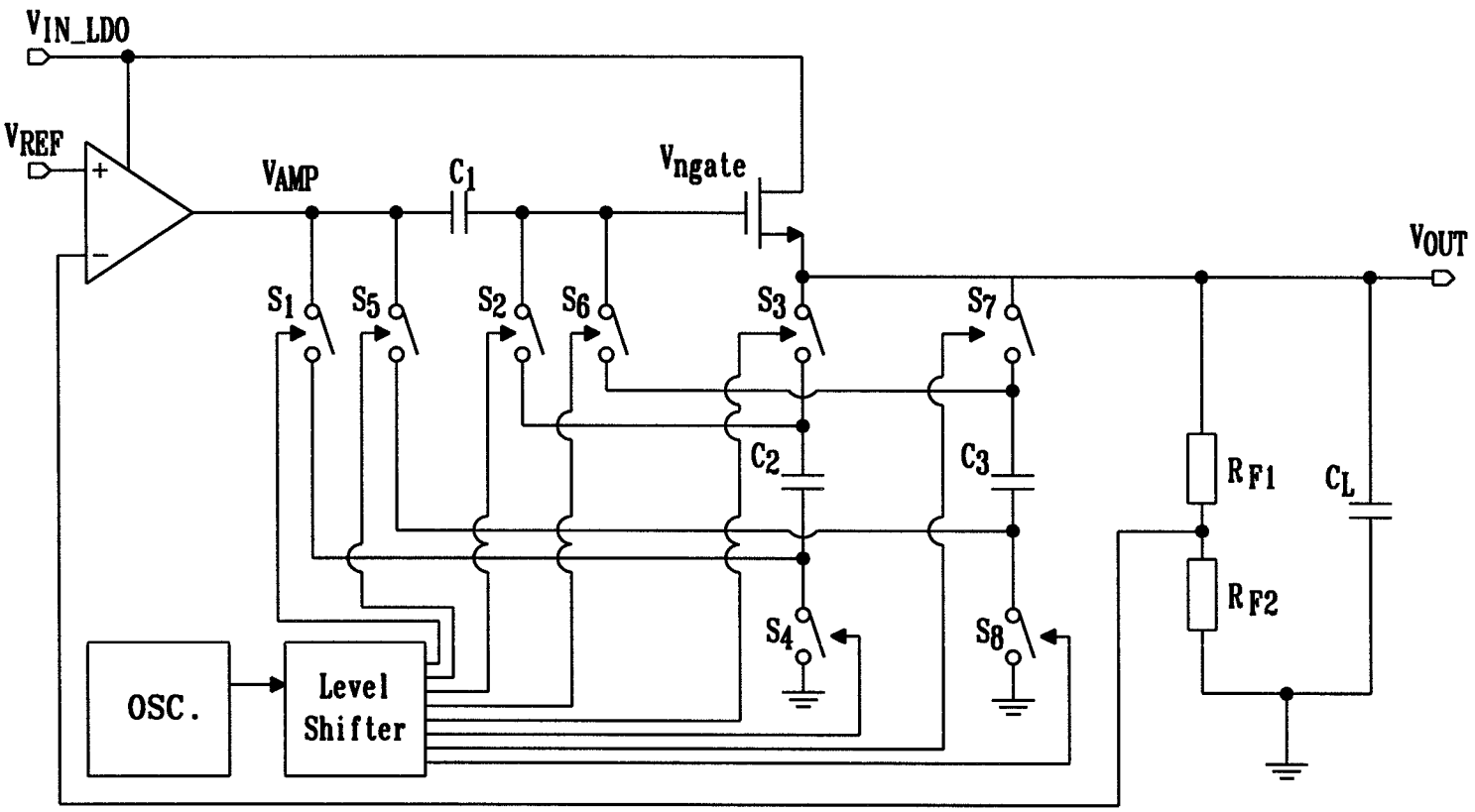
FIG. 5B Prior Art
FIG. 5B is a modified version of the circuit of FIG. 5A.

FIG. 5B is a modified version of the circuit of figure 5A. The operational principle remains the same but in this case the switch capacitor circuit uses three capacitors and eight switches to reduce ripple voltage at $V_{OUT}$. However, the first phase still charges from $V_{OUT}$ to ground, and ripple voltage remains between the first and the second phase.

Figure 6:
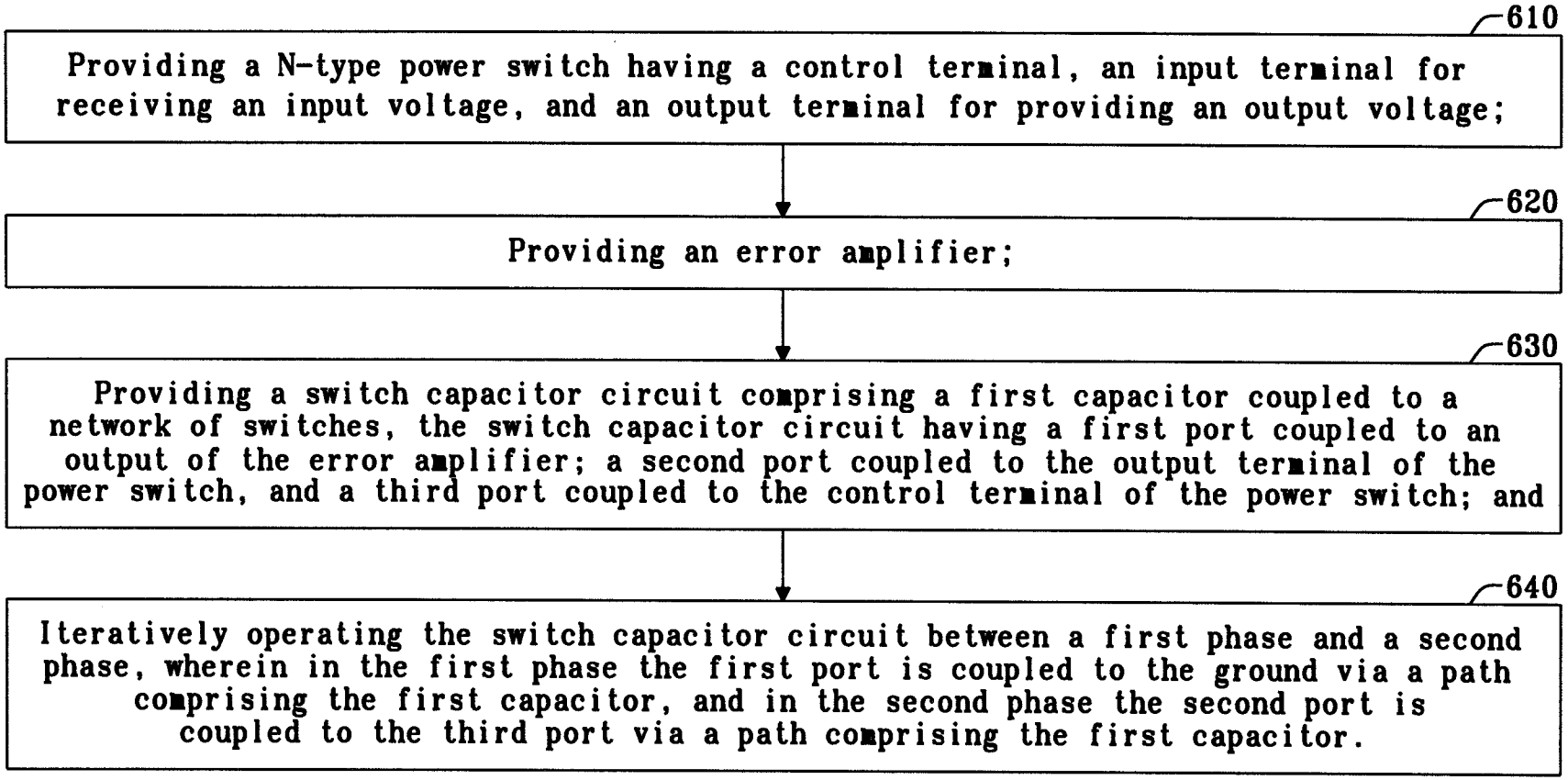
FIG. 6 is a flow chart of a method for regulating a voltage according to the disclosure.

FIG. 6 illustrates a flow chart of a method for regulating a voltage. At step 610 a N-type power switch is provided. The power switch has a control terminal, an input terminal for receiving an input voltage, and an output terminal for providing an output voltage. At step 620 an error amplifier is provided. At step 630 a switch capacitor circuit is provided. The switch capacitor circuit includes a first capacitor coupled to a network of switches, a first port coupled to an output the error amplifier, a second port coupled to the output terminal of the power switch, and a third port coupled to the control terminal of the power switch. At step 640 the switch capacitor circuit is iteratively operated between a first phase and a second phase. In the first phase the first port is coupled to ground via a path comprising the first capacitor. In the second phase the second port is coupled to the third port via a path comprising the first capacitor.

A power switch may be a power transistor such as a power MOSFET (metal-oxide-semiconductor field-effect transistor) or a power IGBT (insulated gate bipolar transistor). A power switch has a different structure from an ordinary (low-power) switch, enabling the power switch to carry a relatively large current and voltages. For instance, a power switch has a low output resistance to deliver a large current to the load and a relatively high junction insulation to withstand high voltages. For example, a power FET transistor may be able to handle more than 1 Ampere of drain current.

Figure 7A:
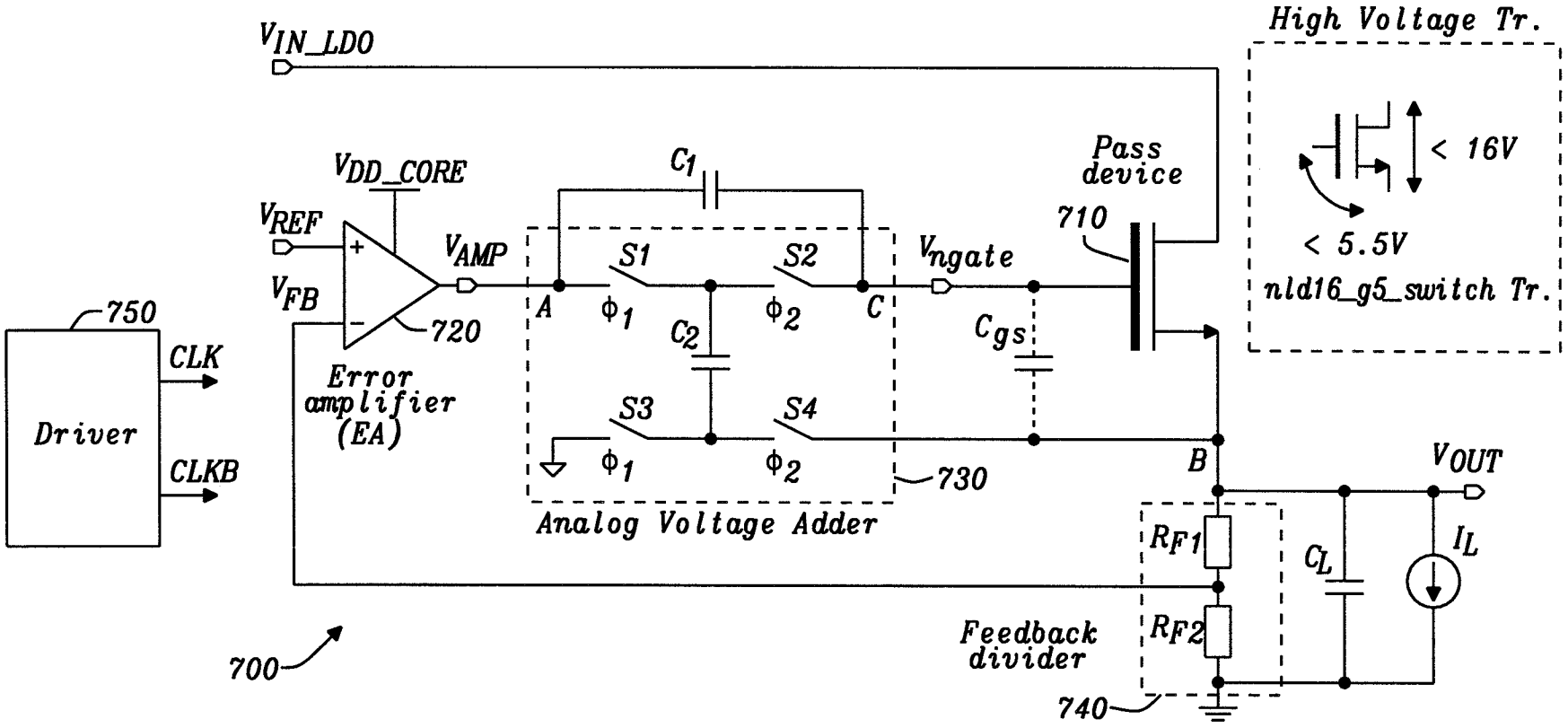
FIG. 7A is a voltage regulator circuit for implementing the method of FIG. 6.

FIG. 7A is a voltage regulator circuit for implementing the method of FIG. 6. The voltage regulator 700 is a low drop out regulator LDO that includes an N-type power switch 710 such as a N-MOSFET power transistor, an error amplifier 720; a switch capacitor circuit 730 also referred to as voltage adder, and a voltage divider 740. The N-type power switch 710 has a control terminal for instance a gate terminal, an input terminal for instance a drain terminal for receiving an input voltage $V_{IN_LDO}$, and an output terminal for instance a source terminal for providing an output voltage $V_{OUT}$. The switch capacitor circuit 730 includes a capacitor C2 coupled to a network of switches formed of four switches S1, S2, S3, and S4. The switch capacitor circuit has a first port A coupled to an output the error amplifier 720, a second port B coupled to the output terminal of the power switch, and a third port C coupled to the control terminal of the power switch. Optionally another capacitor C1 may be provided between the first port A and the third port C. The capacitor C1 may be used as a high pass filter to improve transient behaviour when the output voltage $V_{OUT}$ has dropped due to load current.

The switch S1 is provided between a first terminal of the capacitor C2 and the first port A. The switch S2 is provided between the first terminal of C2 and the third port C. The switch S3 is provided between a second terminal of C2 and ground. The switch S4 is provided between the second terminal of C2 and the second port B. The error amplifier 720 has a first input, for instance an inverting input for receiving a feedback voltage $V_{FB}$ from the voltage divider 740, and a second input for instance a non-inverting input for receiving a reference voltage $V_{REF}$. The error amplifier 720 has another input to receive a rail voltage $V_{DD_CORE}$. Depending on the implementation $V_{DD_CORE}$ may be derived from the input voltage $V_{IN_LDO}$ using a voltage regulator.

A driver 750 is provided for controlling the switch capacitor circuit 730. The driver is adapted to generate the control signal CLK for operating the switches S1, S3 and the control signal CLKB for operating the switches S2 and S4. The driver 750 is configured to operate the switch capacitor circuit iteratively between a first phase and a second phase.

Figure 7B:
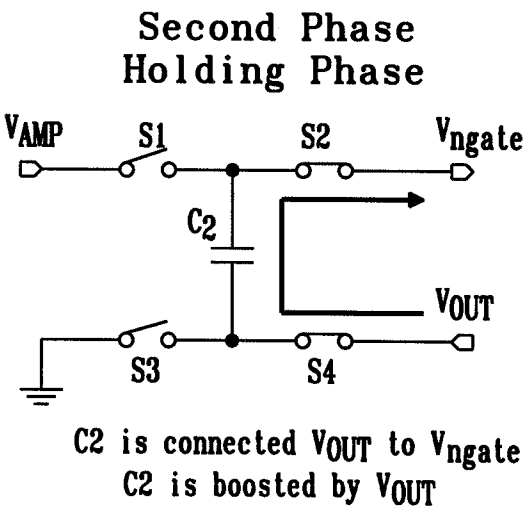
FIG. 7B is a diagram illustrating the operation of the regulator of FIG. 7A.
Figure 7B:
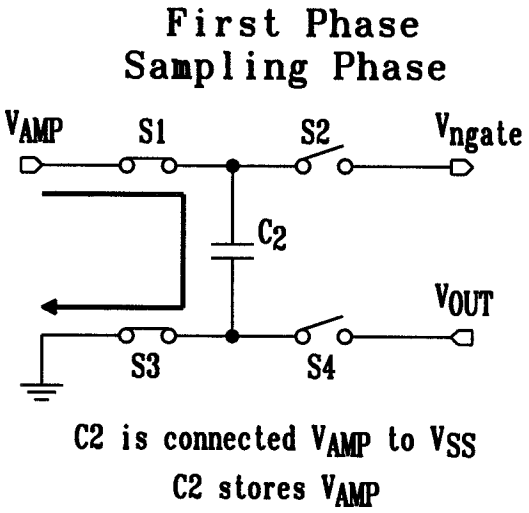
Figure 7B:
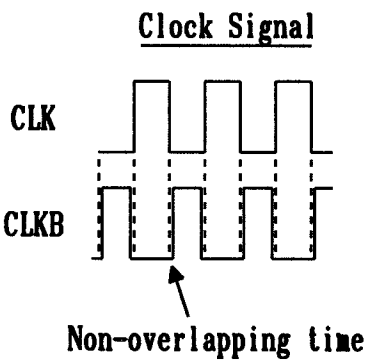

FIG. 7B illustrates the operation of the regulator 700. In operation the switch capacitor circuit 730 drives the gate voltage $V_{ngate}$ of the N-type power switch 710. In the first phase S1, S3 are closed and S2, S4 are open. The first port A is coupled to ground via a path comprising S1, C2 and S3. The capacitor C2 charges to the voltage Vamp. In the second phase S1, S3 are open and S2, S4 are closed. The second port B is coupled to the third port C via a path comprising S4, C2, and S2. The voltage $V_{ngate}=V_{OUT}=V_{AMP}$.

Figure 8A:
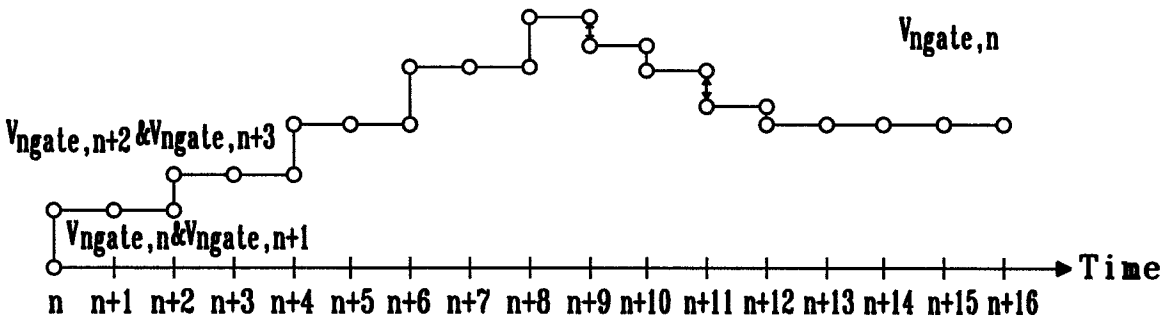
FIG. 8A is a timing diagram showing the evolution of the gate voltage of the N-type pass transistor of FIG. 7A.
Figure 8B:
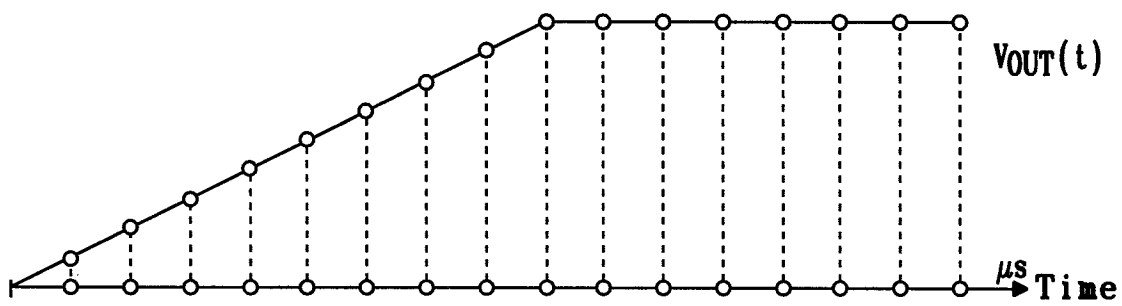
FIG. 8B is a timing diagram showing the evolution of the output voltage $V_{OUT}$ of the LDO of FIG. 7A.
Figure 8C:
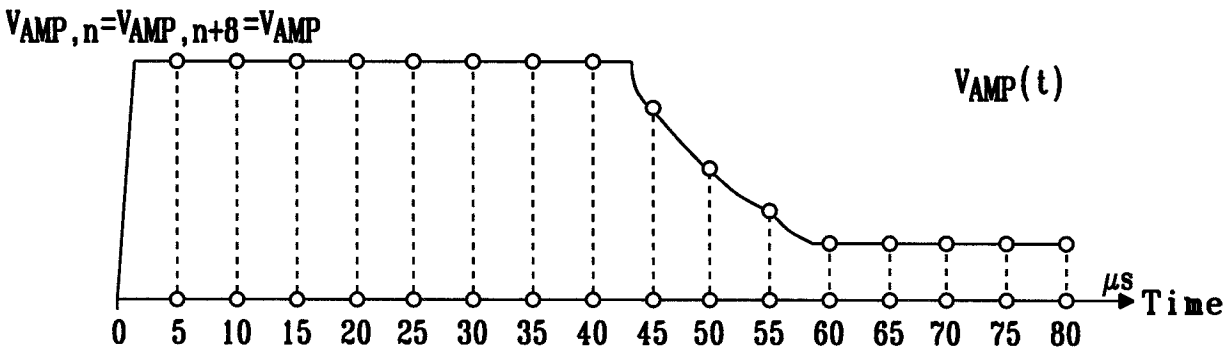
FIG. 8C is a timing diagram showing the evolution of the error amplified voltage $V_{AMP}$ of the LDO of FIG. 7A.

FIG. 8 is a timing diagram showing the evolution of the gate voltage $V_{ngate}$, (FIG. 8A) the output voltage $V_{OUT}$ (FIG. 8B) and the amplified voltage $V_{AMP}$ (FIG. 8 C) for several iterations n. In FIG. 8A the gate voltage $V_{ngate}$ becomes greater than $_{VDD_CORE}$ around iteration n+6.

FIG. 9 illustrates the configuration of the switch capacitor circuit for successive iterations. In order to simplify the equations representing the relationship between $V_{ngate}$, $V_{OUT}$, and $V_{AMP}$ the capacitance of C1, C2 and Cgs have been considered equal in first approximation. It will be appreciated that C1, C2 and Cgs might not be equal. For instance, Cgs may be voltage dependent and C1, C2 may vary depending on implementation. However even for C1, C2 and Cgs having different values, $V_{ngate}=V_{OUT}+V_{AMP}$ after several switching cycles. A switching cycle includes the first phase and the second phase.

Figure 9A:
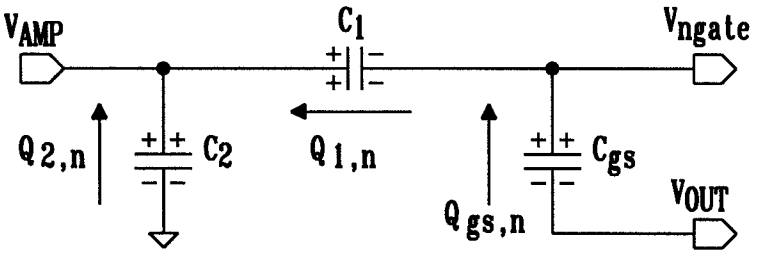
FIG. 9A is a diagram showing the configuration of the switch capacitor circuit in the first phase (sampling phase) at iteration n.

FIG. 9A shows the configuration of the switch capacitor circuit in the first phase (sampling phase) at iteration n. The capacitor C2 is connected to $V_{AMP}$, and $C_1$ is in series with Cgs (the gate to source capacitance of the N power switch). At iteration n, $V_{AMP}=0$, $V_{OUT}=0$, and $V_{ngate,\ n}=(V_{OUT,\ n}+V_{AMP})/3=V_{AMP}/3$, because C2 samples and store $V_{AMP}$. Since the circuit has a current limit function, $V_{OUT}$ starts increasing linearly.

Figure 9B:
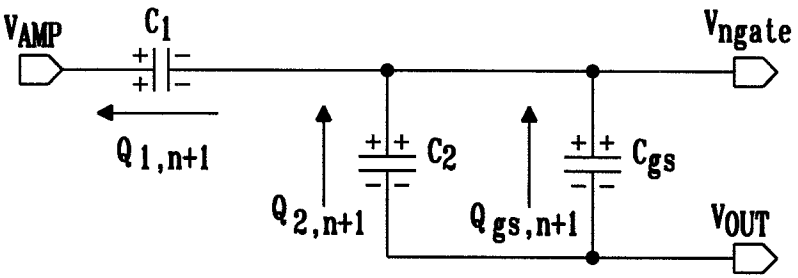
FIG. 9B is a diagram showing the configuration of the switch capacitor circuit in the second phase (holding phase) at iteration n+1.

FIG. 9B shows the configuration of the switch capacitor circuit in the second phase (holding phase) at iteration n+1. The capacitors $C_1$ and $C_{gs}$ keep connection. Because there is no additional charge, $V_{ngate,\ n+1}$ can be expressed as $V_{ngate,\ n+1}=V_{ngate,\ n}=V_{AMP}/3$.

Figure 9C:
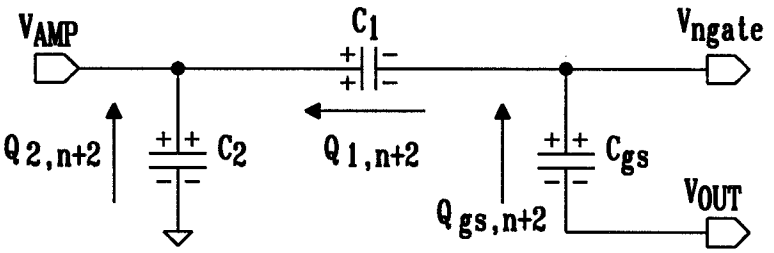
FIG. 9C is a diagram showing the configuration of the switch capacitor circuit in the first phase (sampling phase) at iteration n+2.

FIG. 9C shows the configuration of the switch capacitor circuit in the first phase (sampling phase) at iteration n+2. The capacitor $C_2$ has stored $V_{AMP,\ n+1}$ at iteration n+1. Considering $V_{AMP,\ n+1}=V_{AMP}$, $V_{ngate,\ n+2}$ can be expressed as $V_{ngate,\ n+2}=((5/3)V_{AMP}+2V_{OUT,\ 1})/3$. From $V_{ngate,\ n+1}$ and $V_{ngate,\ n+2}$, it can be shown that $V_{ngate}$ increases by $((4/3)V_{AMP}+2V_{OUT,\ 1})/3$.

Figure 9D:
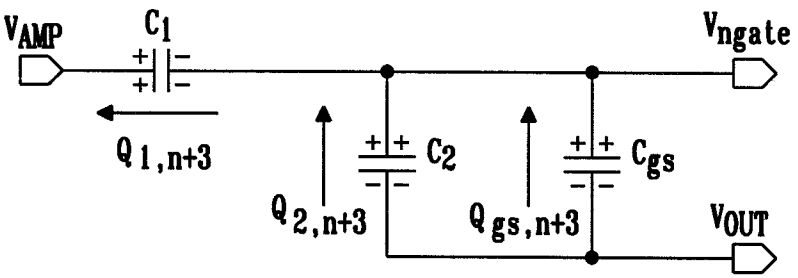
FIG. 9D is a diagram showing the configuration of the switch capacitor circuit in the second phase (holding phase) at iteration n+3.

FIG. 9D shows the configuration of the switch capacitor circuit in the second phase (holding phase) at iteration n+3. This state is the same as FIG. 9B at iteration (n+1). Therefore, operation is also same. The capacitor $C_2$ stores $V_{AMP,\ n+3}$. Because $C_1$ and $C_{gs}$ keep $V_{ngate,\ n+3}$, $V_{ngate,\ n+3}$ can be expressed as $V_{ngate,\ n+3}=V_{ngate,\ n+2}=((5/3)V_{AMP}+2V_{OUT,\ n+2}-V_{OUT,\ 1})/3$. By repeating n+2 and n+3 until n+8, $V_{ngate}$ increases higher than $V_{OUT}$, and the LDO generates the target voltage $V_{OUT}$. Once $V_{OUT}$ reaches the target value, $V_{ngate}$ starts decreasing according to the load current $I_L$ (See FIG. 8).

At start-up the basic operation of the circuit is the same. Using $C_1$ and $C_{gs}$, the error amplifier EA sinks charge and controls $V_{ngate}$. The switch capacitor circuit (voltage adder) behaves like a voltage $V_{DC}$ source connected in series between $V_{AMP}$ and $V_{ngate}$.

Figure 10:
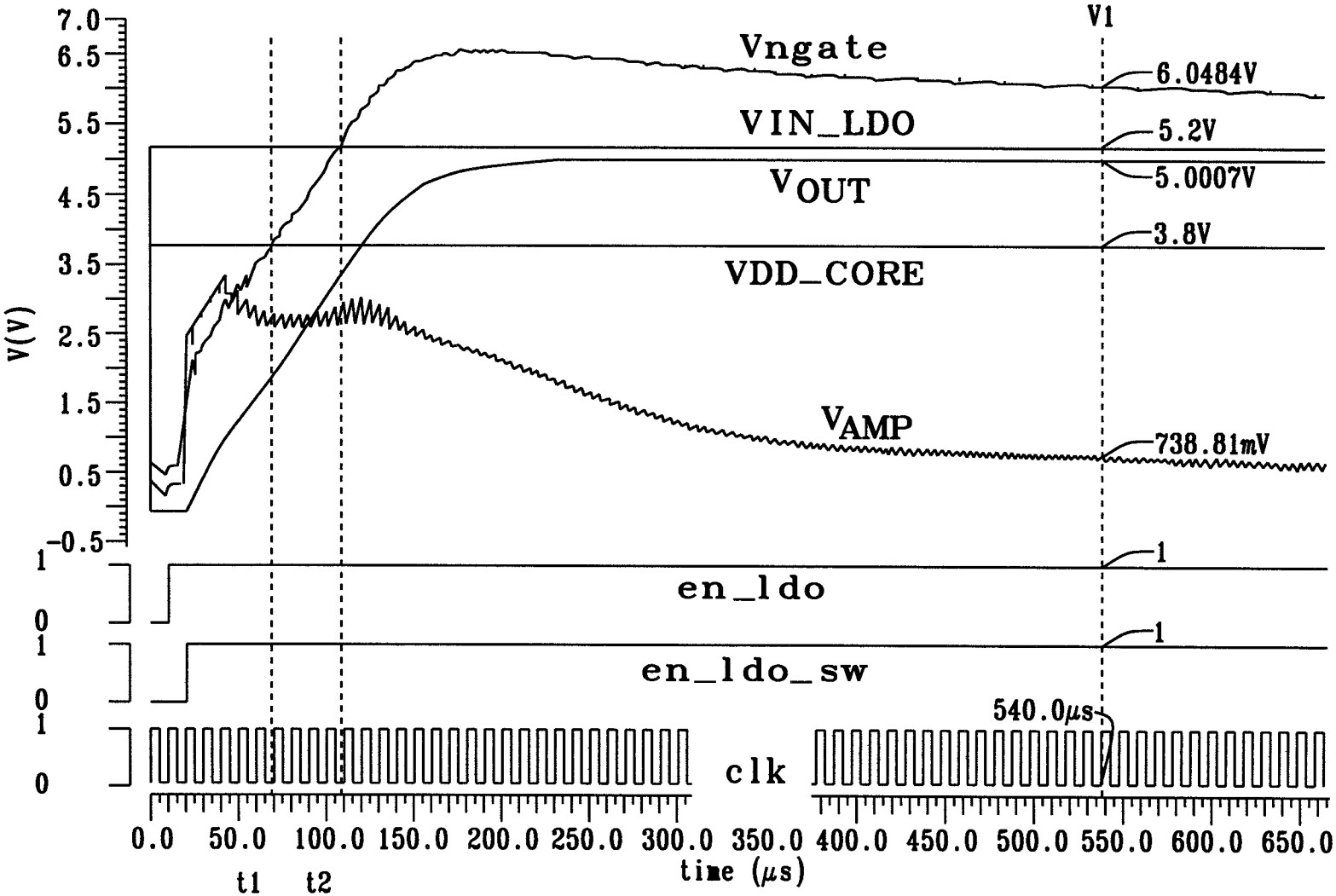
FIG. 10 is a plot showing the transient simulation of the gate voltage Vngate, the error amplified voltage $V_{AMP}$ and the output voltage $V_{OUT}$.

FIG. 10 is plot of a transient simulation of the gate voltage Vngate, the amplified error voltage $V_{AMP}$ and the output voltage $V_{OUT}$ The simulation was obtained for an input voltage $V_{IN_LDO}$=5.2V, a rail voltage $V_{DD_CORE}$=3,8 V, a reference voltage $V_{REF}$=1V, an output capacitance $C_L$=4.7 μF and a load current and $I_L$=0A. The feedback ratio of $R_{F1}$ and $R_{F2}$ was set to 4, and the target output voltage was set to $V_{OUT}$=5.0 V. The simulation shows that the switch capacitor circuit (voltage adder) generates the voltage $V_{ngate}$ without the need for a specific high voltage rail supply $V_{DD_CORE}$. As explained above the voltage adder behaves like voltage $V_{DC}$ source. In this simulation the gate voltage $V_{ngate}$ becomes greater than $V_{DD_CORE}$ at time t1=70 μs and greater than $V_{IN_LDO}$ at time t2=110 μs.

Figure 11:
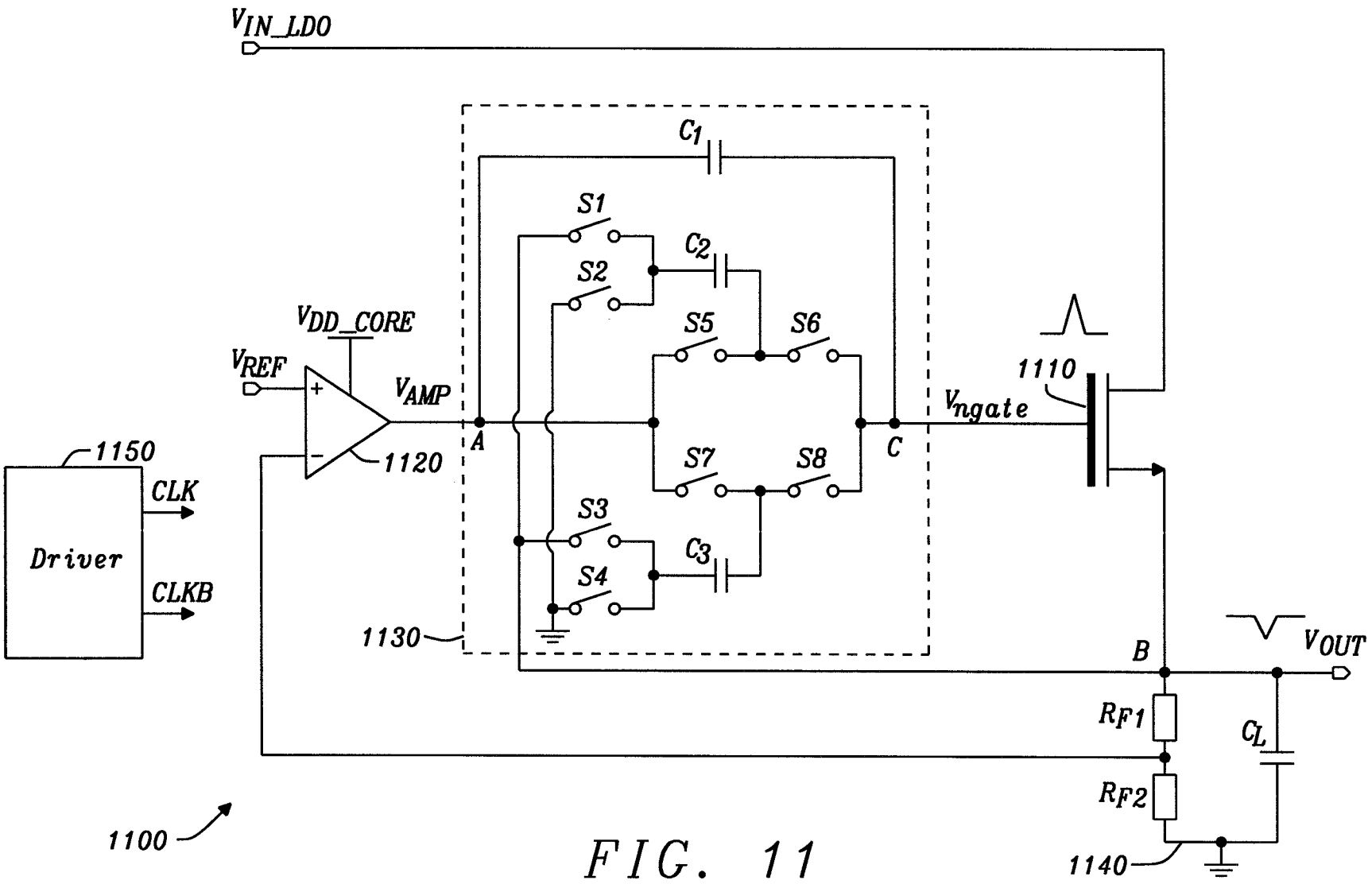
FIG. 11 is a diagram of another voltage regulator circuit for implementing the method of FIG. 6.

FIG. 11 is another voltage regulator circuit for implementing the method of FIG. 6. The voltage regulator 1100 is a low drop out regulator LDO that includes an N-type power switch 1110 such as a N-MOSFET transistor, an error amplifier 1120; a switch capacitor circuit 1130 also referred to as voltage adder, and a voltage divider 1140. The main difference of circuit 1100 with the circuit 700 is the implementation of the switch capacitor circuit.

The switch capacitor circuit 1130 has a first port (node A) coupled to the output the error amplifier 1120, a second port (node B) coupled to the output terminal of the N-type power switch 1110, and a third port (node C) coupled to the control terminal of the power switch 1110. The switch capacitor circuit 1130 includes three capacitor C1, C2 and C3 and eight switches S1-S8.

The capacitor C1 has a first terminal coupled to the first port A and a second terminal coupled to the third port C. The capacitor C1 is optional and may be used as a high pass filter to improve transient behaviour when the output voltage $V_{OUT}$ has dropped due to load current. The capacitor C2 has a first terminal coupled to the first port (A) via switch S5 and to the third port (C) via switch S6. The capacitor C2 has a second terminal coupled to the second port (B) via switch S1 and to ground via switch S2. The capacitor C3 has a first terminal coupled to the first port (A) via switch S7 and to the third port (C) via switch S8. The capacitor C3 has a second terminal coupled to the second port (B) via switch S3 and to ground via switch S4.

A driver 1150 is provided for controlling the switch capacitor circuit 1130. The driver is adapted to generate the control signal CLK for operating the switches S1, S4, S6, S7 and the control signal CLKB for operating the switches S2, S3, S5, S8. The driver 1150 is configured to operate the switch capacitor circuit iteratively between a first phase (phase A) and a second phase (Phase B).

Figure 12A:
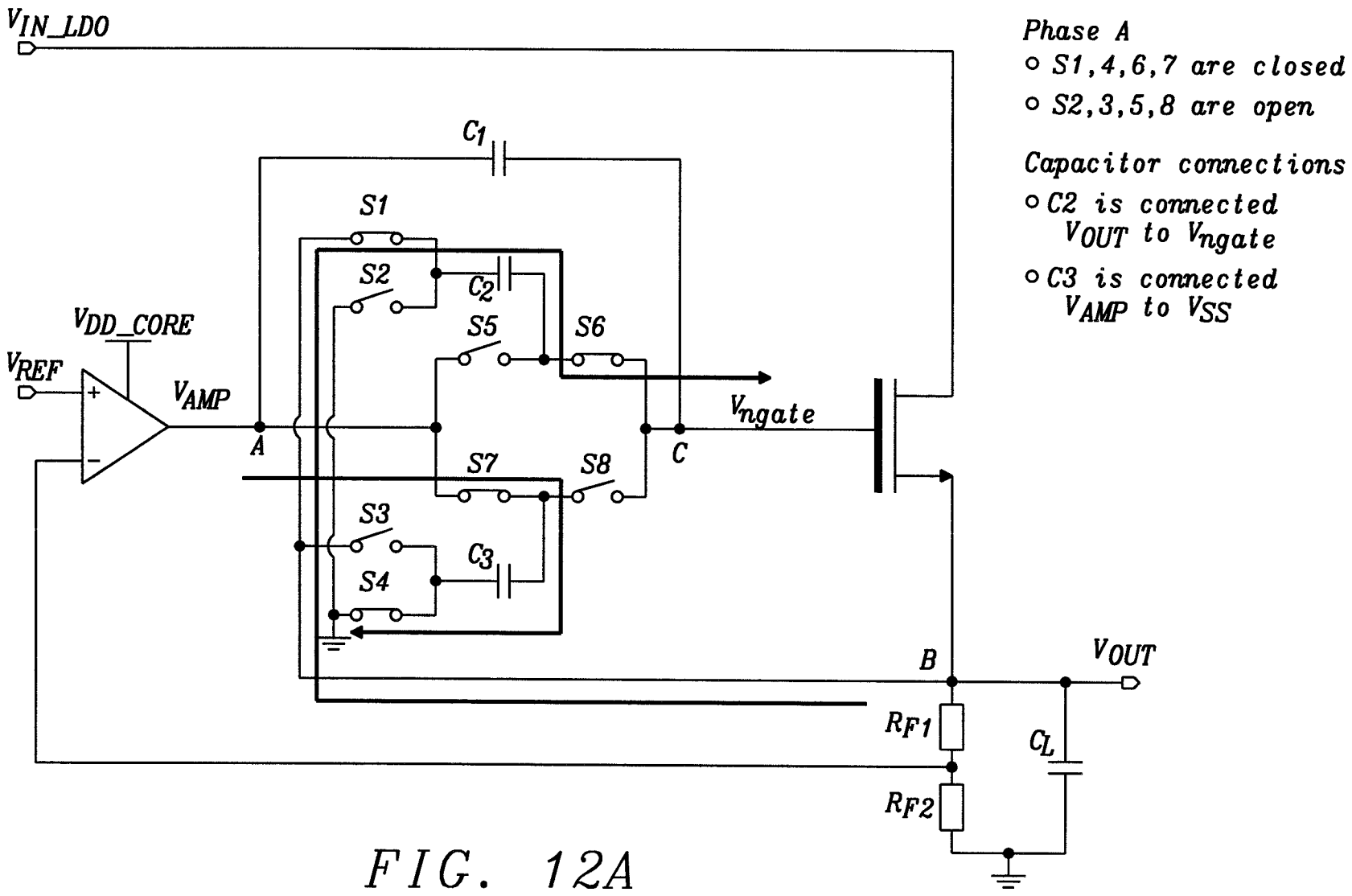
FIG. 12A is a diagram showing the operation of the regulator of FIG. 11 in a first state.
Figure 12B:
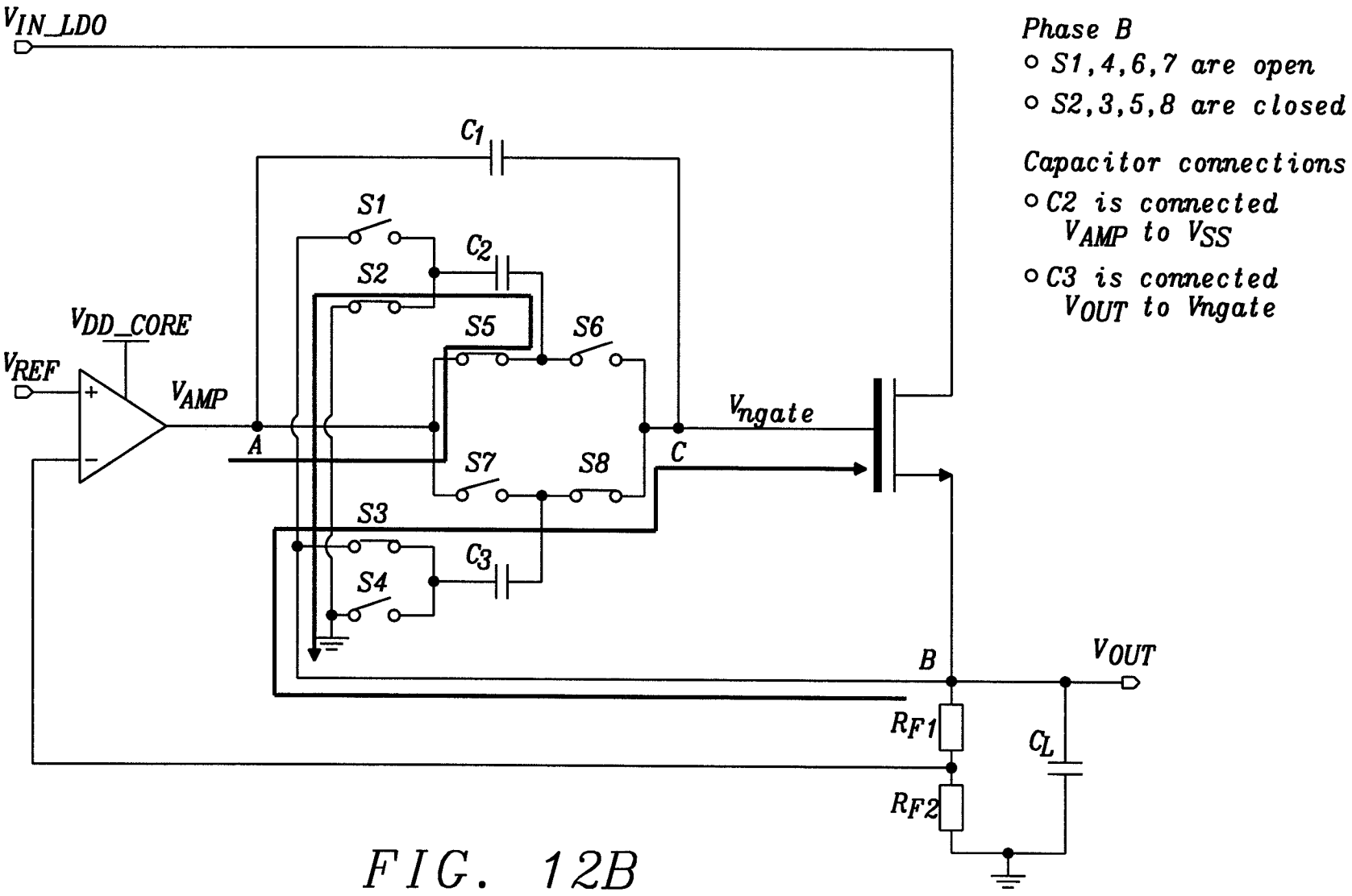
FIG. 12B is a diagram showing the operation of the regulator of FIG. 11 in a second state.

FIGS. 12A and 12B illustrates the operation of the regulator 1100 in phase A and phase B respectively. In operation the switch capacitor circuit 1130 drives the gate voltage $V_{ngate}$ of the N-type power switch 1110.

In the phase A the switches S1, S4, S6, S7 are closed and the switches S2, S3, S5, S8 are open. The first port (A) is coupled to ground via a path comprising S7, C3 and S4. The capacitor C3 charges to the voltage Vamp. The second port (B) is coupled to the third port (C) via a path comprising S1, C2, and S6. The voltage $V_{ngate}=V_{OUT}+V_{(C2)}$.

In the phase B the switches S1, S4, S6, S7 are open and the switches S2, S3, S5, S8 are closed. The first port (A) is coupled to ground via a path comprising S5, C2 and S2. The capacitor C2 charges to the voltage Vamp. The second port (B) is coupled to the third port (C) via a path comprising S3, C3, and S8. The voltage $V_{ngate}=V_{OUT}+V_{(C3)}$.

Since the gate voltage $V_{ngate}$ is generated by boosting, a $V_{ngate}$ overshoot occurs during transition periods between the first phase and the second phase due to load current. Since $V_{ngate}$ increases and $V_{OUT}$ decreases during transient, the gate to source voltage of the N-type power switch Vgs (NMOS)=$V_{ngate}-V_{OUT}$ increases. As $V_{ngate}$ increases more current passes through the NMOS transistor and hence reducing the $V_{OUT}$ undershoot. This reduces the ripple voltage at the output.

Figure 13A:
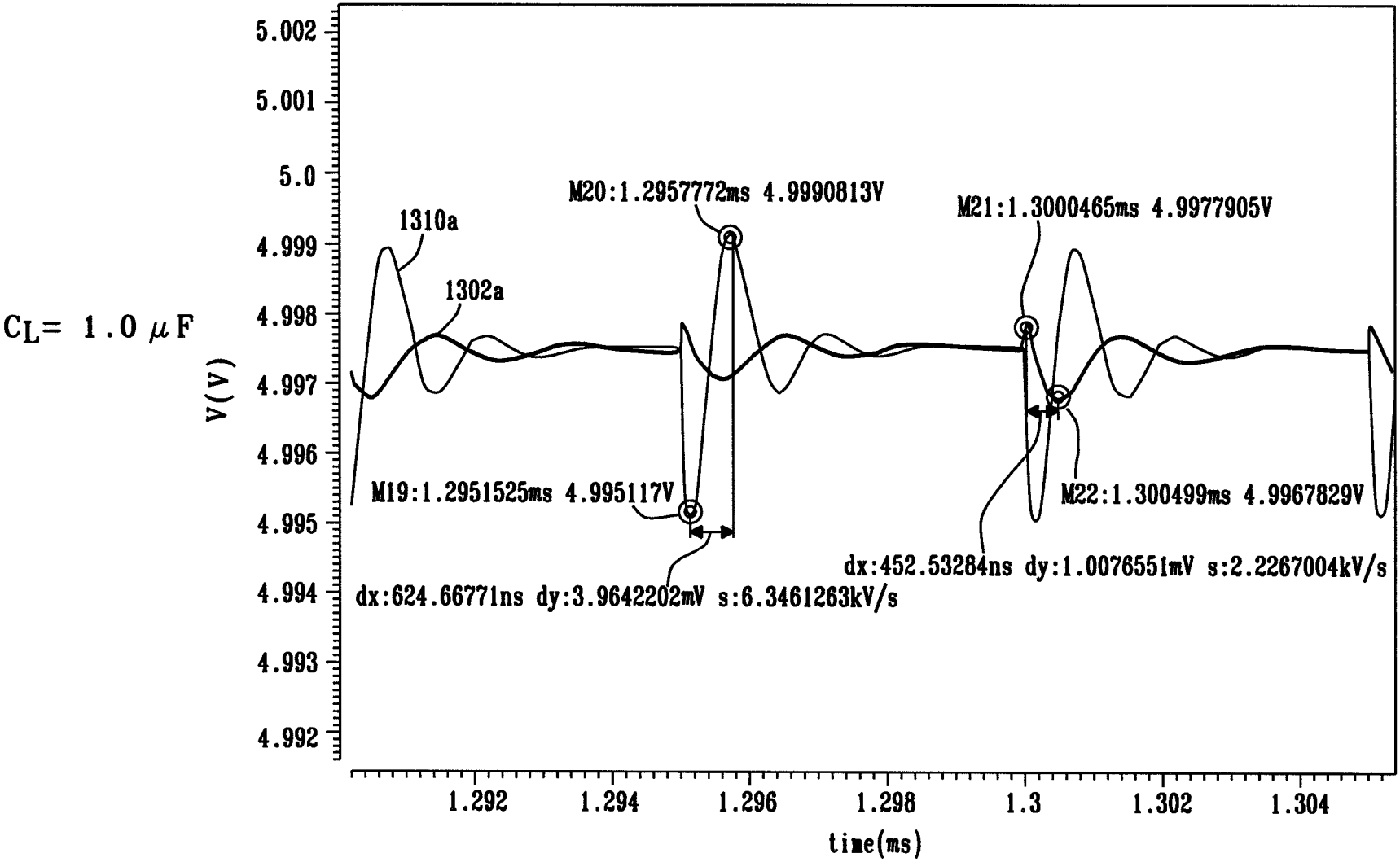
FIG. 13A is a transient simulation comparing the output voltage Vout during a transient period obtained using the prior art circuit of FIG. 5 and the circuit of the disclosure as shown in FIG. 11, for an output capacitance of 1 μF.
Figure 13B:
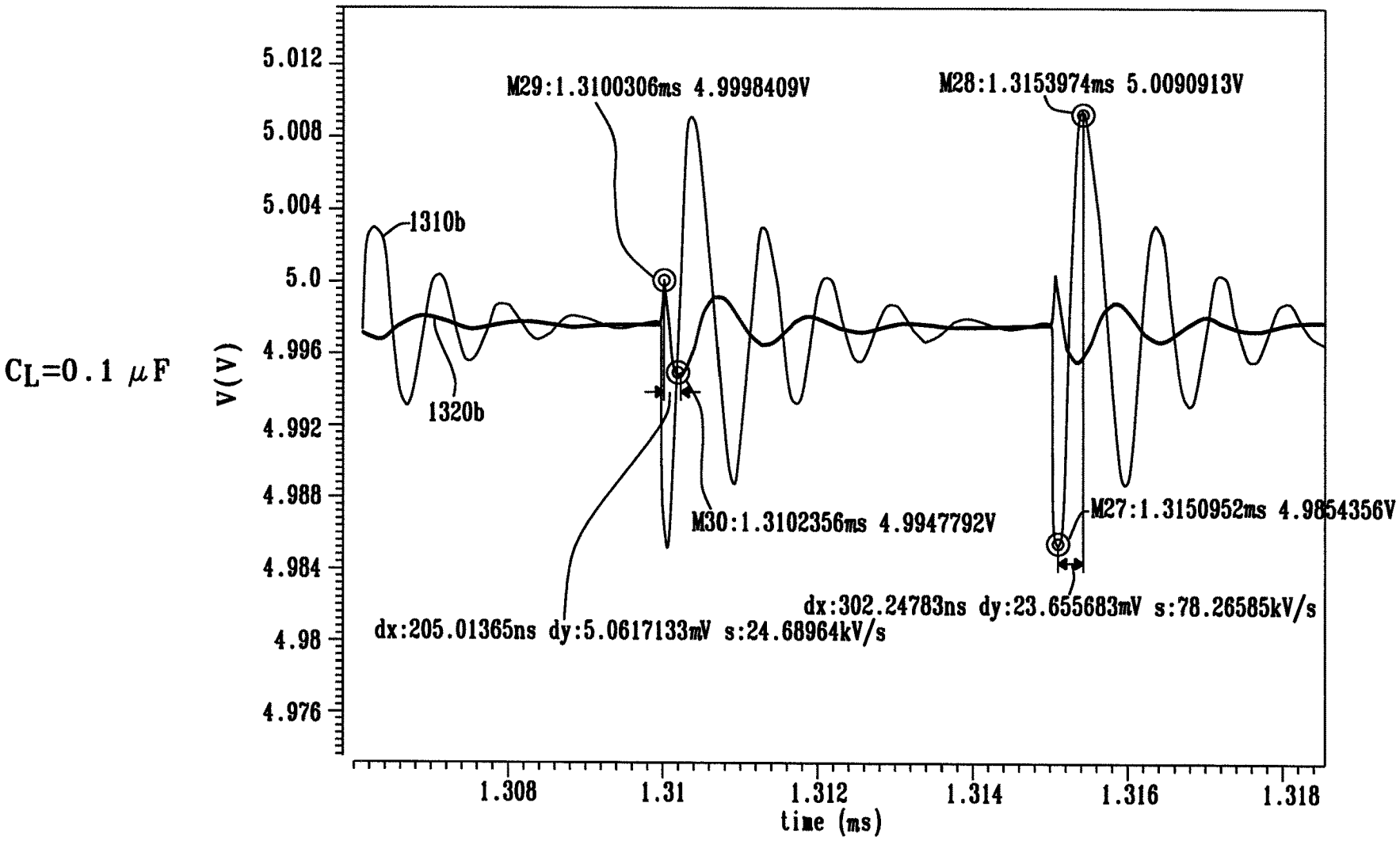
FIG. 13B is a transient simulation comparing the output voltage Vout during a transient period obtained using the prior art circuit of FIG. 5 and the circuit of the disclosure as shown in FIG. 11, for an output capacitance of 0.1 μF.

FIGS. 13A and 13B are transient simulation plots comparing the output voltage Vout during transient periods obtained using the prior art circuit of FIG. 5 (waveform 1310) and the circuit of the disclosure as shown in FIG. 11 (waveform 1320). The transient simulations were obtained with a load current of 200 mA. The output capacitance $C_L$ was changed from 4.7 μF to 0.1 μF. The simulation of FIG. 13A was obtained for an output capacitance CL=1 μF. The simulation of FIG. 13B was obtained for an output capacitance CL=0.1 μF.

For the LDO of the prior art FIG. 5, the voltage $V_{ngate}$ tends to undershoot during a transition period between the first phase and the second phase. Therefore, undershoot happens at both $V_{ngate}$ and $V_{OUT}$. Consequently, ripple voltage is relatively large. In contrast in the circuit of the disclosure (for instance the circuit of FIG. 7A or FIG. 11), the voltage $V_{ngate}$ tends to overshoot during a transition period. This reduces the undershoot occurring at $V_{OUT}$, hence reducing ripple voltage.

Figures 14A, 14B:
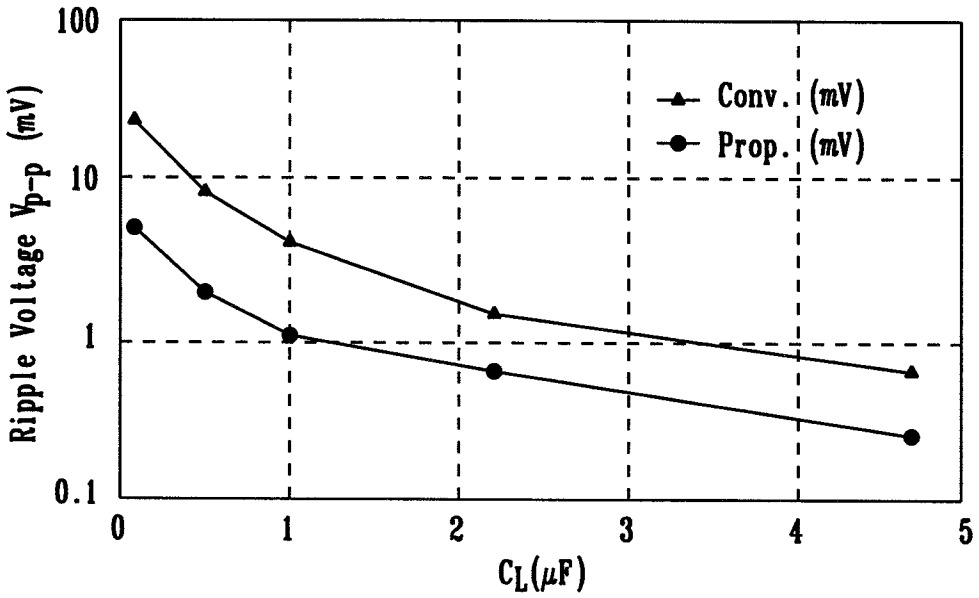
FIG. 14A is a plot of the peak to peak ripple voltage obtained for different output capacitance values.
FIG. 14B is a table showing the percentage reduction rate of voltage ripple for different output capacitance values.

FIG. 14A is a plot of the peak-to-peak ripple voltage as a function of the output capacitance $C_L$. FIG. 14B is a corresponding table showing the percentage reduction rate of voltage ripple for different $C_L$ values. The reduction rate of ripple voltage is more than 50%. Therefore, the proposed circuit can employ smaller output capacitance than conventional one, hence reducing circuit footprint and bill of materials.

Figure 15:
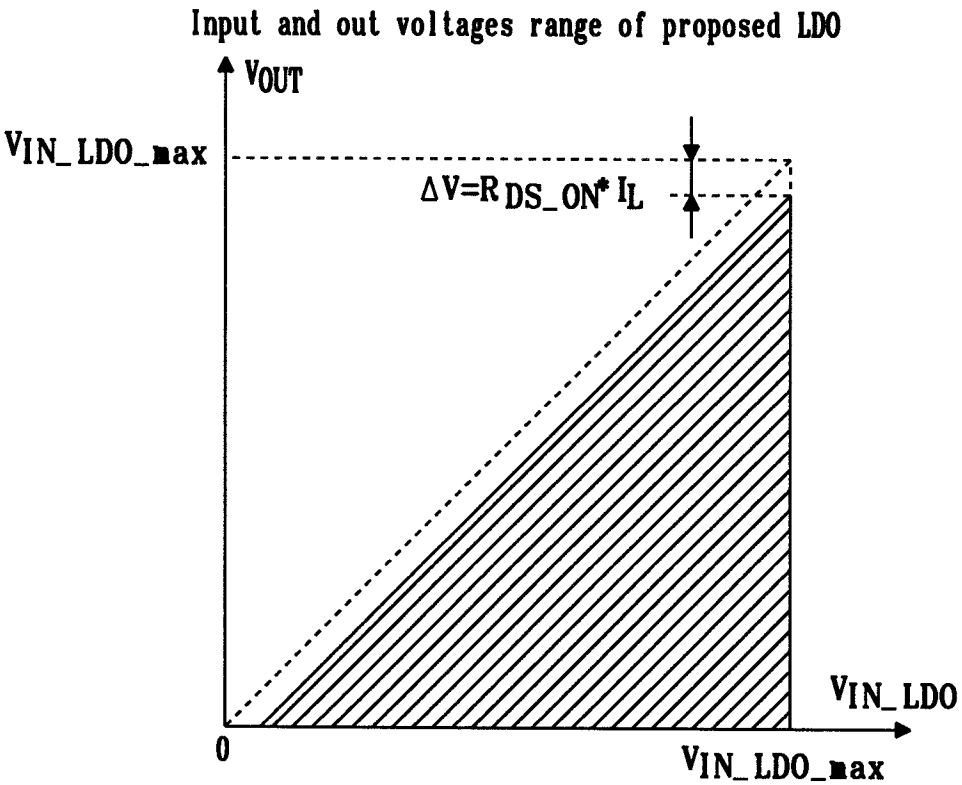
FIG. 15 is a plot of the LDO output voltage as a function of the LDO input voltage obtained for the LDO of the disclosure.

FIG. 15 is a plot of the LDO output voltage as a function of the LDO input voltage obtained for the LDO of the disclosure (like in FIG. 4 $V_{IN_LDO}$ is the same as $V_{DD\text{-}CORE}$). Compared with the plots presented in FIG. 4, the proposed LDO of the disclosure can operate for a greater range of input voltage $V_{IN_LDO}$ values. The switched capacitor circuit (voltage adder) allows the gate of the N-type power transistor to exceed the rail voltage $V_{DD\text{-}CORE}$ of the error amplifier that drives it. This allows the LDO circuit of the disclosure to operate almost across the full rail-to-rail input voltage range (Vss (ground) up to $V_{IN_LDO_max}$).

Therefore, the voltage regulator circuit of the present disclosure permits to reduce output ripple voltage and allows the implementation of a circuit with smaller output capacitance. There is also no need for a specific high input rail voltage $V_{IN_LDO}$ to achieve high current and voltage capability. The proposed voltage regulator can operate across a wide $V_{IN_LDO}$ rail-to-rail range without the need for a specific $V_{DD_CPRE}$ voltage supplied at the error amplifier.

Figure 16:
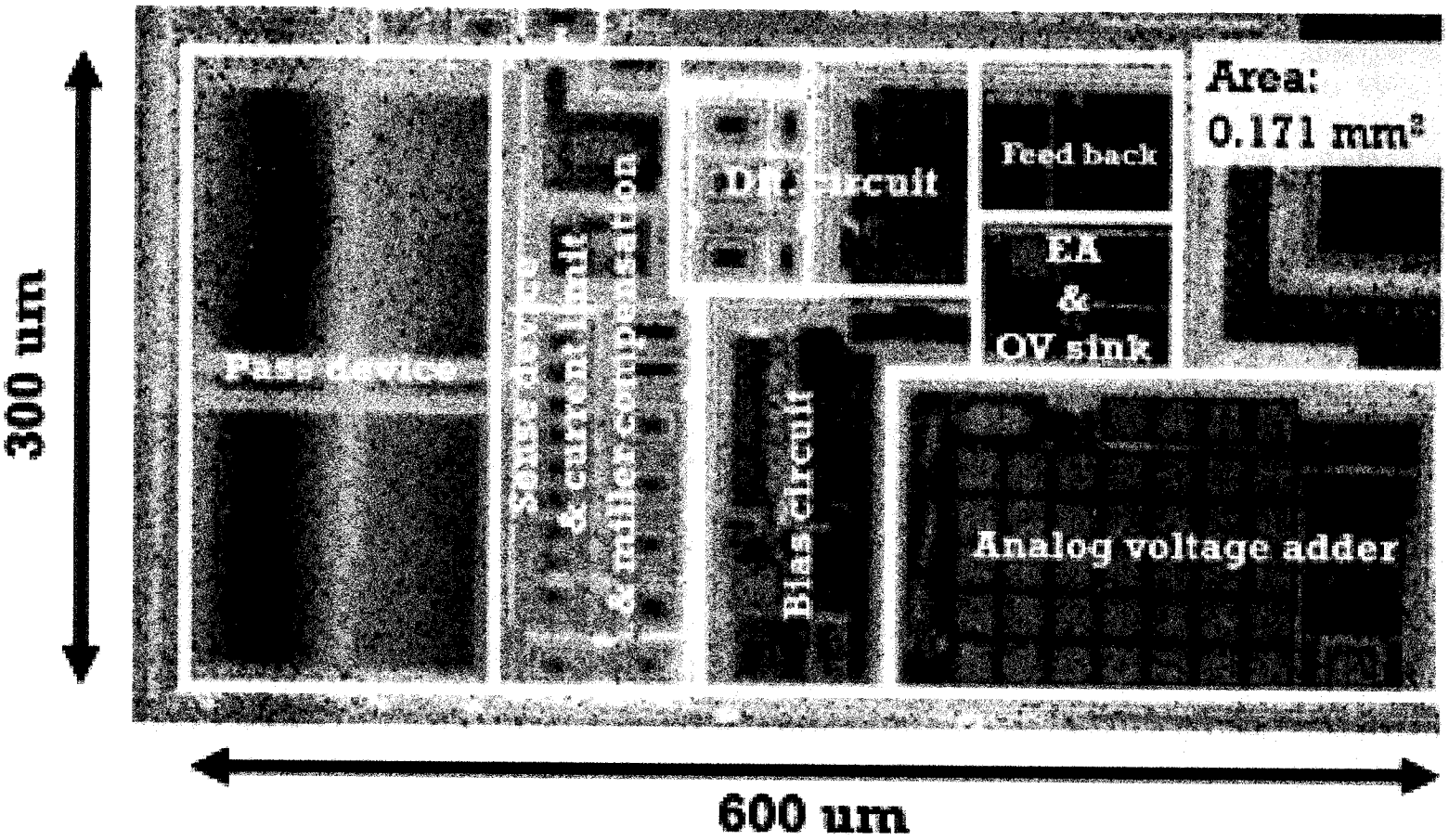
FIG. 16 shows a chip micrograph of the circuit of the disclosure.

FIG. 16 shows a chip micrograph of the circuit of the disclosure. The circuit was implemented using 130-nm CMOS BCD pure 5-V process without options of MIM capacitor, HRI-resistor, and RDL. In this example the circuit was implementation with an area is 0.171 $mm^2$. Several measurements were obtained for an output capacitor of 2.2 μF.

Figure 17:
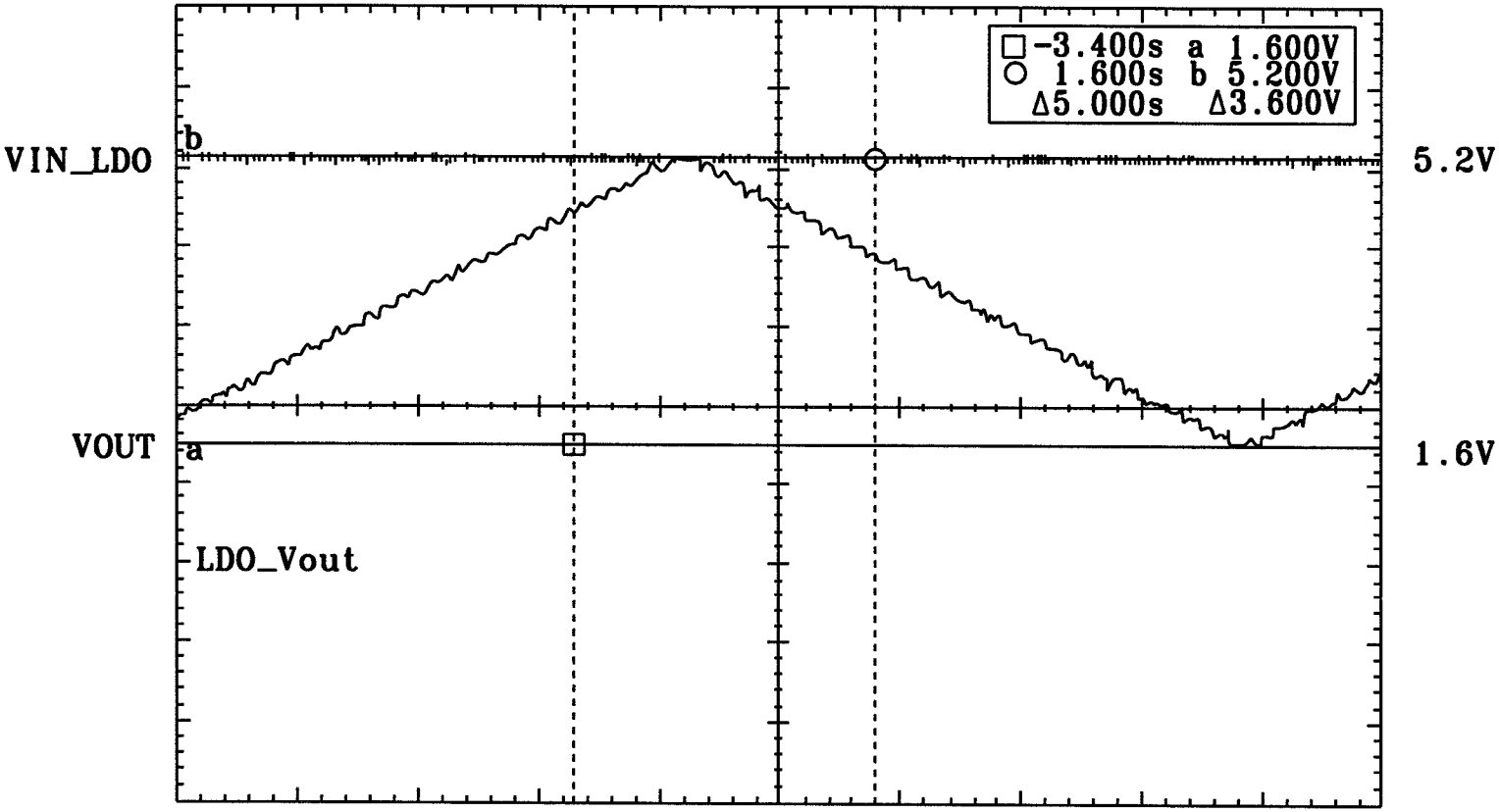
FIG. 17 is a plot showing different selected values of the output voltage Vout.

FIG. 17 is a plot showing $V_{OUT}$ selectability. The input voltage $V_{IN_LDO}$ was 5.2 V. The output voltage $V_{OUT}$ was observed by changing a configuration register via inter-integrated circuit I2C. In this example the output voltage $V_{OUT}$ can be changed from 1.6 to 5.2 V as desired by varying the feedback resistor ratio ($R_{F1}/R_{F2}$) of the voltage divider. The proposed LDO can therefore change $V_{OUT}$ on the fly, hence providing dynamic voltage scaling capability.

Figure 18A:
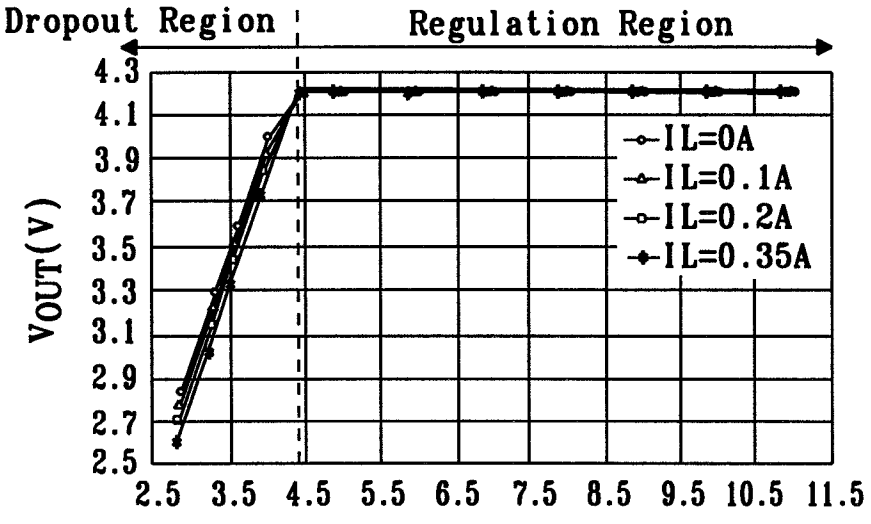
FIGS. 18A and 18B are plots showing the output voltage of the LDO as a function of the input voltage for different load current values.
Figure 18B:
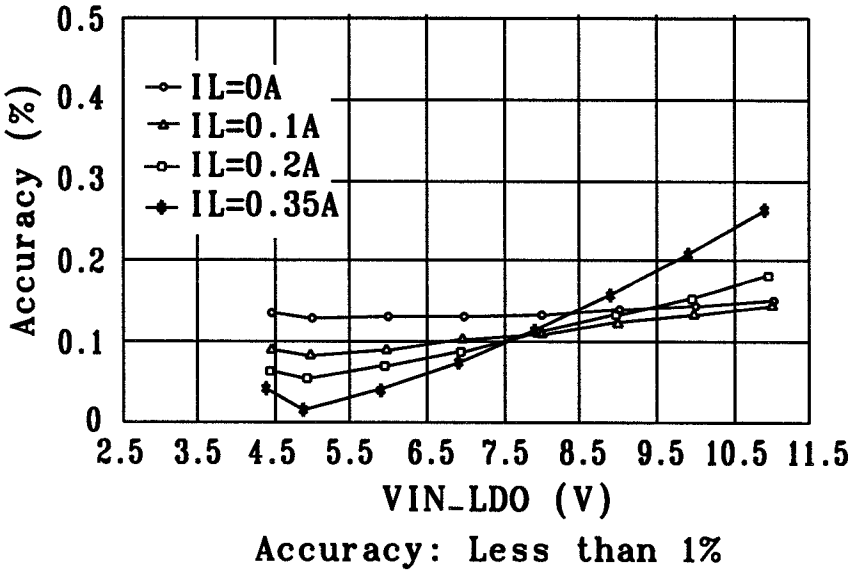

FIGS. 18A and 18B show line and load regulation by setting a target voltage of 4.2 V. The load current was changed from 0 to 0.35 A. When $V_{IN_LDO}$ is less than $V_{OUT}$, the LDO operates in the so-called dropout region. In this region, the LDO is fully turned on. As a result, $V_{OUT}$ is directly affected by $R_{DS_ON}$, metal printed circuit board PCB parasitic resistor and load current. Since the proposed circuit achieved low-$R_{DS_ON}$, the dropout voltage ($V_{IN_LDO}-V_{OUT}$) was relatively small. The voltage drop is small even if the LDO operates in the dropout region. As a result, the proposed LDO can operate even if $V_{IN_LDO}$ changes from 2.8 to 11 V. In the regulation region a high $V_{OUT}$ accuracy was achieved with less than 1% variation for different load currents and input voltages.

Figure 19:
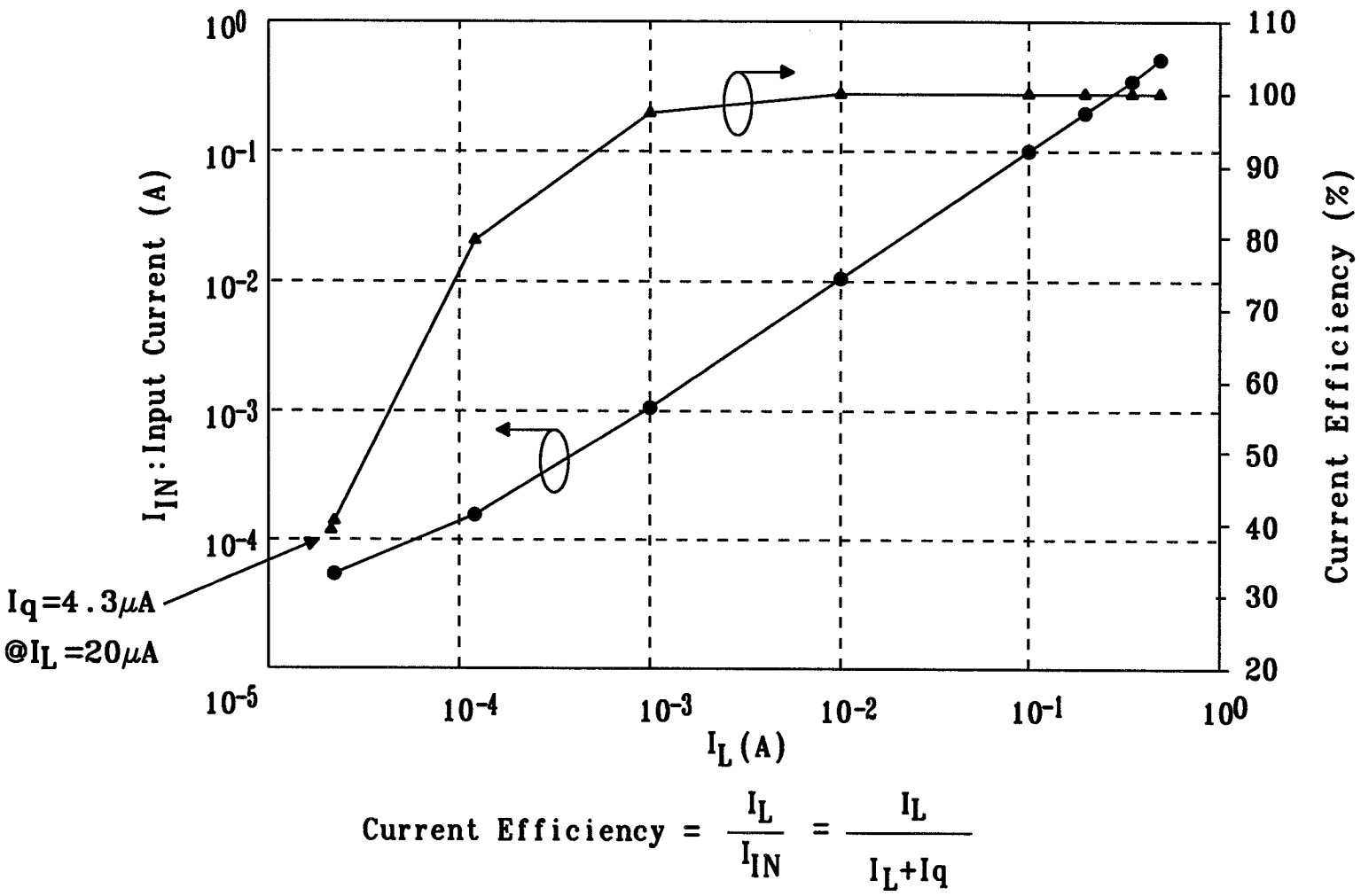
FIG. 19 is a plot showing the LDO current efficiency.

FIG. 19 is a plot showing the current efficiency defined as $I_L/I_L+Iq$), in which $I_L$ is the load current and the Iq is the quiescent current of the LDO (amount of current consumed by the LDO at no load $I_L=0$). The LDO circuit of the disclosure does not need adaptive biasing for the gate driver circuit. Iq increases linearly across load current but remains smaller than $I_L$, thus current efficiency is high. The main component of the circuit that consumes Iq as $I_L$ increased is the over current protection circuit shown in FIG. 16. Current efficiency is high even in light load condition, specifically, current efficient is about 80% for $I_L$ greater than 100 μA. The LDO circuit of the disclosure can also achieve low-Iq operation at no load condition if the circuit employs low-power design for control circuit such as the error amplifier.

Figure 20:
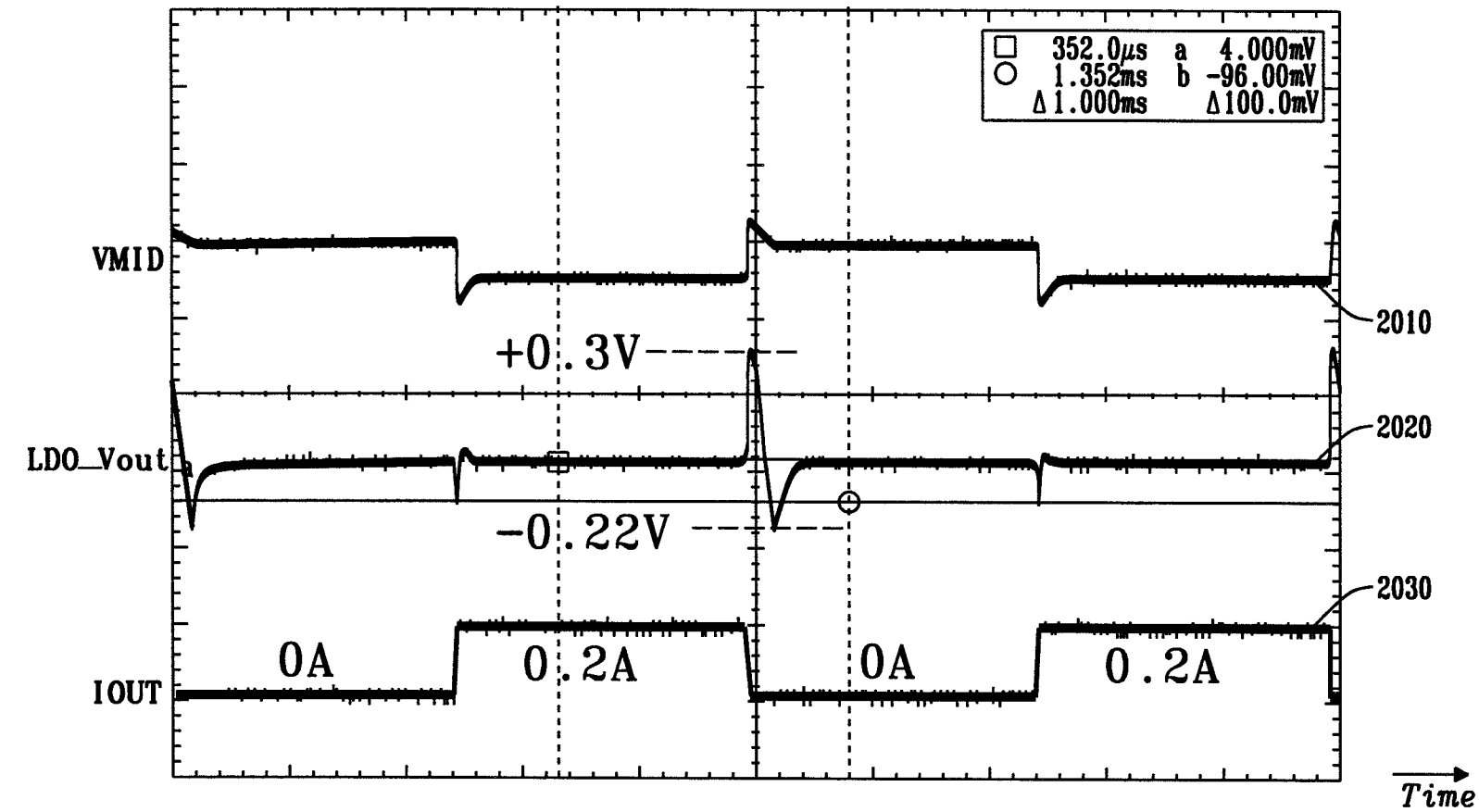
FIG. 20 is a plot of the input voltage, the output voltage and the load current of the LDO during load transient.

FIG. 20 shows the input voltage $V_{IN_LDO}$ 2010, the output voltage $V_{OUT}$ 2020 and the load current $I_L$ 2030 during load transient. This is an AC coupling view showing only voltage variations. The voltages $V_{IN_LDO}$ and $V_{OUT}$ were 4.5 and 4.2 V, respectively. The load current $I_L$ was changed from 0 to 0.2 A with $t_R=t_F$ 1 μs. Voltage variations were +7.1% and −5.2%.

Figure 21:
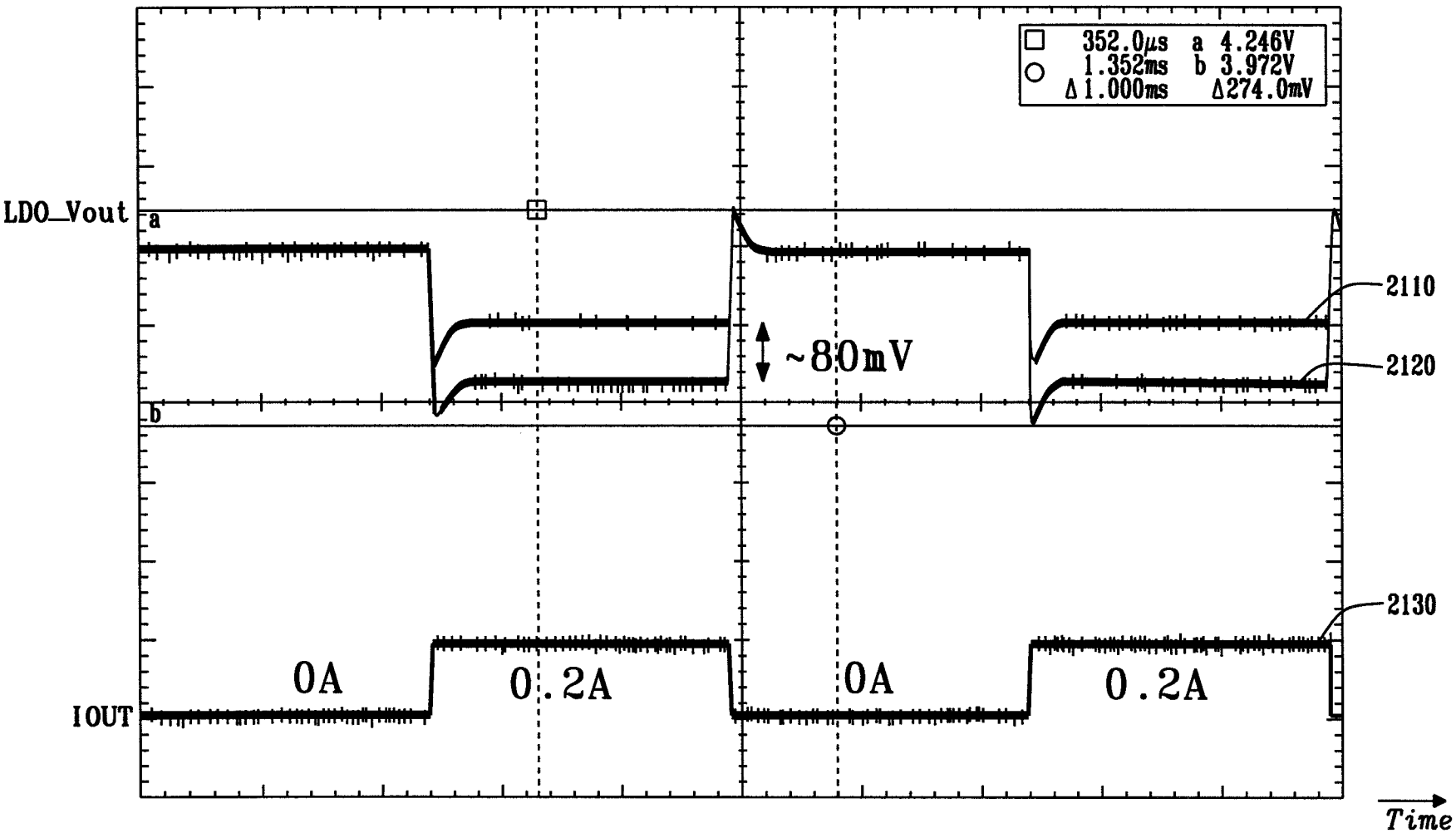
FIG. 21 is another plot of the input voltage, the output voltage and the load current of the LDO during load transient obtained for different values of the input voltage and the output voltage.

FIG. 21 shows the input voltage $V_{IN_LDO}$ 2110, the output voltage $V_{OUT}$ 2120 and the load current $I_L$ 2130 during load transient with other setting. The main difference is that $V_{IN_LDO}$ and $V_{OUT}$ were both set to 4.5 V in this case. The voltage $V_{IN_LDO}$ 2110 displays a voltage drop due to parasitic impedance from the PCB or measurement instrument. At transient, the voltage $Vds=V_{IN_LDO}-V_{OUT}=80$ mV. Therefore, the proposed LDO can operate with narrow a Vds.

Figure 22:
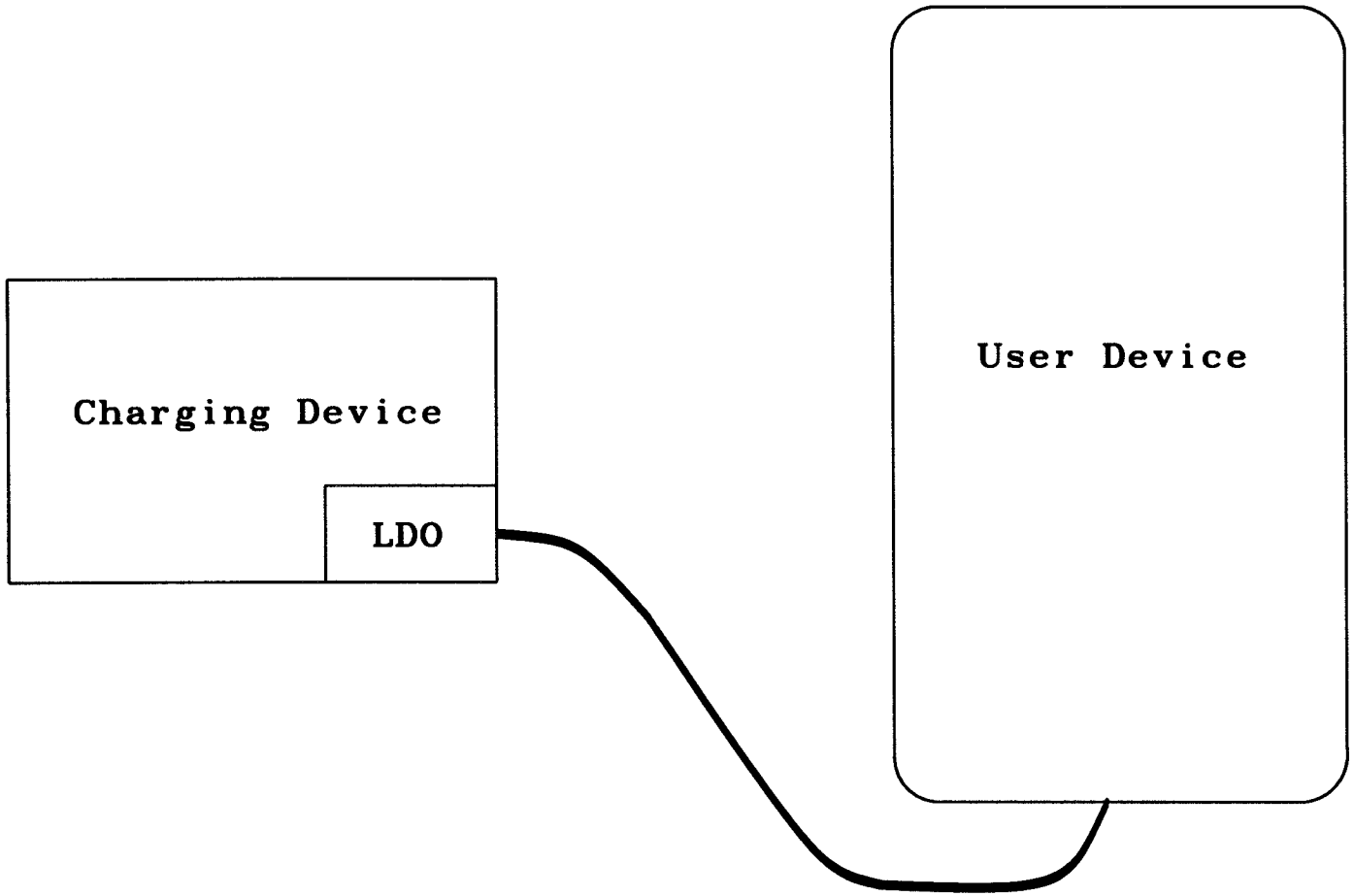
FIG. 22 is a diagram of a charging device connected to a user device such as a mobile phone.

FIG. 22 is a diagram of a charging device connected to a user device such as a mobile phone. The charging device include an LDO according to the disclosure. The charging device may be connected to the user device via a USB cable.

A skilled person will appreciate that variations of the disclosed arrangements are possible without departing from the disclosure. Accordingly, the above description of the specific embodiment is made by way of example only and not for the purposes of limitation. It will be clear to the skilled person that minor modifications may be made without significant changes to the operation described.

What is claimed is:

1. A voltage regulator comprising a power switch having a control terminal, an input terminal for receiving an input voltage, and an output terminal for providing an output voltage, wherein the power switch is a N-type power switch; an error amplifier; and a switch capacitor circuit comprising a first capacitor coupled to a network of switches, the switch capacitor circuit having a first port coupled to an output of the error amplifier, a second port is directly coupled to the output terminal of the power switch, and a third port coupled to the control terminal of the power switch, the switch capacitor circuit being iteratively operable between a first phase and a second phase, wherein in the first phase the first port is coupled to ground via a path comprising the first capacitor, and in the second phase the second port is coupled to the third port via a path comprising the first capacitor.

2. The voltage regulator as claimed in claim 1, wherein the error amplifier is adapted to provide an error voltage, and wherein the switch capacitor circuit is adapted to generate a control voltage for controlling the power switch.

3. The voltage regulator as claimed in claim 2, wherein during the first phase the first capacitor charges.

4. The voltage regulator as claimed in claim 3, wherein during the first phase the first capacitor charges to a voltage substantially equal to the error voltage.

5. The voltage regulator as claimed in claim 2, wherein during the second phase the control voltage is maintained at a given value.

6. The voltage regulator as claimed in claim 2, wherein the first phase and the second phase form a switching cycle.

7. The voltage regulator as claimed in claim 6, wherein the control voltage reaches a value substantially equal to the sum of the error voltage and the output voltage after a plurality of iterations of the switching cycle.

8. The voltage regulator as claimed in claim 2, wherein the control voltage increases during a transient period between the first phase and the second phase.

9. The voltage regulator as claimed in claim 2, wherein the control voltage increases above a rail voltage provided to the error amplifier.

10. The voltage regulator as claimed in claim 1, wherein the network of switches comprises a first switch to couple a first terminal of the first capacitor to the first port;

a second switch to couple the first terminal of the first capacitor to the third port;

a third switch to couple a second terminal of the first capacitor to the second port;

a fourth switch to couple the second terminal of the first capacitor to ground.

11. The voltage regulator as claimed in claim 10, wherein the switch capacitor circuit comprises a second capacitor, wherein in the first phase the second port is couple to the third port via a path comprising the second capacitor, and wherein in the second phase the first port is coupled to the ground via a path comprising the second capacitor.

12. The voltage regulator as claimed in claim 11, wherein the network of switches comprises a fifth switch to couple a first terminal of the second capacitor to the first port;

a sixth switch to couple the first terminal of the second capacitor to the third port;

a seventh switch to couple a second terminal of the second capacitor to the second port;

an eighth switch to couple the second terminal of the second capacitor to ground.

13. The voltage regulator as claimed in claim 1, wherein the switch capacitor circuit comprises another capacitor provided between the first port and the third port.

14. The voltage regulator as claimed in claim 1, wherein the voltage regulator is a linear voltage regulator.

15. A charging device comprising the voltage regulator as claimed in claim 1.

16. A method of regulating a voltage, the method comprising providing a N-type power switch having a control terminal, an input terminal for receiving an input voltage, and an output terminal for providing an output voltage; providing an error amplifier; providing a switch capacitor circuit comprising a first capacitor coupled to a network of switches, the switch capacitor circuit having a first port coupled to an output of the error amplifier, a second port is directly coupled to the output terminal of the power switch, and a third port coupled to the control terminal of the power switch; and iteratively operating the switch capacitor circuit between a first phase and a second phase, wherein in the first phase the first port is coupled to ground via a path comprising the first capacitor, and in the second phase the second port is couple to the third port via a path comprising the first capacitor.

* * * * *